US006591081B2

(12) United States Patent
Hasegawa

(10) Patent No.: US 6,591,081 B2
(45) Date of Patent: Jul. 8, 2003

(54) FIXING APPARATUS INCLUDING TONER RELEASING AGENT APPLYING DEVICE AND IMAGE FORMING APPARATUS INCLUDING THE SAME FIXING APPARATUS

(75) Inventor: Kenichi Hasegawa, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/977,708

(22) Filed: Oct. 16, 2001

(65) Prior Publication Data

US 2002/0044805 A1 Apr. 18, 2002

(30) Foreign Application Priority Data

Oct. 16, 2000 (JP) ..... 2000-315041
Sep. 10, 2001 (JP) ..... 2001-273354

(51) Int. Cl.[7] ..... G03G 15/20
(52) U.S. Cl. ..... 399/324; 118/60; 399/325
(58) Field of Search ..... 399/324, 325; 118/60

(56) References Cited

U.S. PATENT DOCUMENTS 4,751,548 A * 6/1988 Lawson ..... 399/325
4,924,271 A * 5/1990 Brinton et al. ..... 399/325
5,270,776 A * 12/1993 Landa ..... 399/325 X
5,353,107 A * 10/1994 Sculley et al. ..... 399/324 X
5,991,562 A * 11/1999 Ito et al. ..... 399/325 X
6,131,009 A 10/2000 Hasegawa ..... 399/328

FOREIGN PATENT DOCUMENTS

| | | |
|---|---|---|
| JP | 60-16928 | 5/1985 |
| JP | 4-44657 | 4/1992 |
| JP | 5-197307 | 8/1993 |
| JP | 7-121047 | 5/1995 |

* cited by examiner

*Primary Examiner*—William J. Royer
(74) *Attorney, Agent, or Firm*—Oblon, Spivak, McClelland, Maier & Neustadt, P.C.

(57) ABSTRACT

A fixing apparatus for fixing a toner image on a recording material includes a fixing member, a pressing member that press-contacts a surface of the fixing member, and a toner releasing agent applying device that conveys and applies toner releasing agent onto the surface of the fixing member. The toner releasing agent applying device includes a toner releasing agent holding unit that holds toner releasing agent and includes a toner releasing agent supply opening, a permeable toner releasing agent delivering member that delivers toner releasing agent from the toner releasing agent holding unit to the surface of the fixing member and a toner releasing agent conveying unit that conveys toner releasing agent to the toner releasing agent holding unit. The toner releasing agent delivering member is supplied with the toner releasing agent in the toner releasing agent holding unit through the toner releasing agent supply opening.

50 Claims, 9 Drawing Sheets

FIXING APPARATUS INCLUDING TONER RELEASING AGENT APPLYING DEVICE AND IMAGE FORMING APPARATUS INCLUDING THE SAME FIXING APPARATUS

BACKGROUND OF THE INVENTION

1. Field of the Invention

The present invention relates to a fixing apparatus including a toner releasing agent applying device, and an image forming apparatus including the same fixing apparatus.

2. Discussion of the Background

An electrophotographic image forming apparatus includes a fixing apparatus for fixing a toner image on a recording material. Generally, the fixing apparatus includes a roller or belt-like shaped fixing member arranged extending in a width direction of a recording material, and a roller or belt-like shaped pressing member which press-contacts and rotates with the fixing member. At least one of the fixing member and the pressing member is heated to a predetermined temperature or greater. A toner image on a recording material is fused and fixed thereon under the influence of heat and pressure while the recording material passes through a nip part between the fixing member and the pressing member. Especially in a fixing apparatus for use in an image forming apparatus that forms a color image with multicolor toner, at least one of the fixing member and the pressing member is kept at a high temperature for enhancing toner fixing performance.

The surfaces of the fixing member and the pressing member are coated with a low frictional material such as silicone rubber in order to prevent fused toner from adhering to the surfaces of the fixing member and the pressing member. Further, toner releasing agent such as silicone oil (hereinafter simply referred to as oil) is uniformly applied onto the coated surfaces of the fixing member and the pressing member by a toner releasing agent applying device (hereinafter simply referred to as oil applying device).

The oil applying device includes an oil applying member such as a roller which is arranged extending in a longitudinal direction of the fixing member, and which uniformly applies oil onto the fixing member. The oil applying device further including an oil pan arranged below the oil applying member to hold oil therein, and an oil delivering member which delivers the oil in the oil pan to the oil applying member.

In order to uniformly supply oil to the oil applying member, the oil delivering member includes a band shaped felt member extending in a width direction of a recording material. The oil delivering member is attached to a bracket arranged in a vicinity of the oil applying member, and one or two extending parts, which extend to the oil pan, are provided with the oil delivering member. Thus, the oil delivering member is arranged to function as a bridge between the oil pan and the oil applying member. With this configuration, oil in the oil pan is taken up by capillary phenomenon of the extending part, so that the oil delivering member is soaked with the oil.

As an alternative to a method of taking up oil in the oil pan by use of capillary phenomenon, another method in which oil is dropped to a substantially center part of an oil supply member by an oil conveying device may be employed.

In the above-described fixing apparatus including the oil applying device, it takes time to supply oil to the oil applying member. This is because oil is supplied from the oil pan arranged below the oil applying member to the oil applying member all by use of capillary phenomenon of a felt member as the oil delivering member. Therefore, when toner images are consecutively formed on recording materials, and the recording materials having unfixed toner images are consecutively conveyed to the fixing apparatus, oil cannot be supplied to the oil applying member in time, so that sufficient oil cannot be uniformly applied onto the fixing member. In the worst case, the fixing member may lack oil. When the fixing member runs out of oil, a so called offset condition tends to occur, in which fused toner adheres to the fixing member and the toner adhered to the fixing member re-transfers onto a recording material.

Further, as compared to a case in which the fixing member is applied with sufficient oil, abrasion of the fixing member and the pressing member due to contact with a recording material is increased, thereby hastening deterioration of the fixing member and the pressing member. Such defect is likely to occur especially in a color image forming apparatus in which a color toner image is fixed at a relatively high temperature.

In a fixing apparatus employing the above-described another method in which oil is dropped to a substantially center part of the oil supply member by the oil conveying device, the oil supply member tends to lack the oil around end portions thereof. This is because the oil is supplied to the oil supply member at one substantially center part thereof. Although the end portions of the oil supply member can be supplied with sufficient oil by increasing the number of oil supply points, this may cause complexity of the construction of the fixing apparatus.

SUMMARY OF THE INVENTION

According to one aspect of the present invention, a fixing apparatus for fixing a toner image on a recording material includes a fixing member arranged on a recording material conveying path, a pressing member configured to press-contact a surface of the fixing member, and a toner releasing agent applying device configured to convey and apply toner releasing agent onto the surface of the fixing member. The toner releasing agent applying device includes a toner releasing agent holding unit configured to hold toner releasing agent and including a toner releasing agent supply opening, a permeable toner releasing agent delivering member configured to deliver toner releasing agent from the toner releasing agent holding unit to the surface of the fixing member, the toner releasing agent delivering member being supplied with the toner releasing agent in the toner releasing agent holding unit through the toner releasing agent supply opening, and a toner releasing agent conveying unit configured to convey toner releasing agent to the toner releasing agent holding unit.

According to another aspect of the present invention, the toner releasing agent holding unit may be arranged in a vicinity of the fixing member and opposite to the fixing member at a distance apart, and the toner releasing agent delivering member may be arranged between the toner releasing agent holding unit and the fixing member, and the toner releasing agent delivering member may include a first end surface which contacts the fixing member, and a second end surface opposing the first end surface and facing an inside of the toner releasing agent holding unit through the toner releasing agent supply opening.

According to another aspect of the present invention, the toner releasing agent applying device may further include at least one toner releasing agent applying member configured to apply toner releasing agent onto the surface of the fixing member, and the toner releasing agent holding unit may be arranged in a vicinity of at least one toner releasing agent applying member and opposite to at least one toner releasing agent applying member at a distance apart, and the toner releasing agent delivering member may be arranged between the toner releasing agent holding unit and at least one toner releasing agent applying member, and the toner releasing agent delivering member may include a first end surface which contacts at least one toner releasing agent applying member, and a second end surface opposing the first end surface and facing an inside of the toner releasing agent holding unit through the toner releasing agent supply opening.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
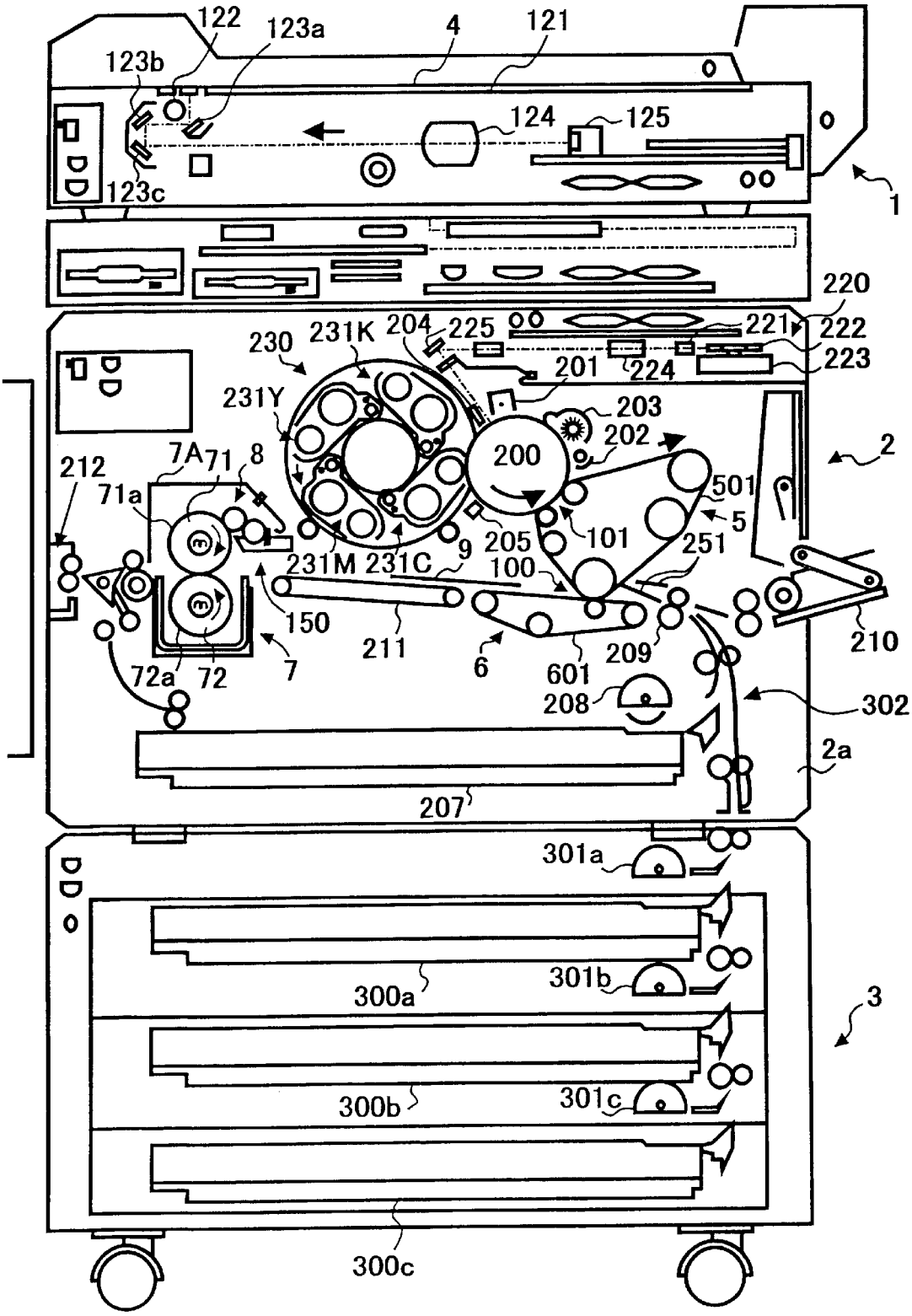
FIG. 1 is a schematic view of an overall structure of an image forming apparatus including a fixing apparatus according to an embodiment of the present invention.

Preferred embodiments of the present invention are described in detail referring to the drawings, wherein like reference numerals designate identical or corresponding parts throughout the several views.

FIG. 1 is a schematic view of an overall structure of an electrophotographic color photocopier serving as an image forming apparatus in which the present invention is applied. The color photocopier includes a color scanner 1 as a color image-reading device, a color printer 2 as a color image forming device, and a sheet feeding bank 3 as a sheet feeding device.

The color scanner 1 includes an illuminating lamp 122 as a light source, mirrors 123*a*, 123*b*, and 123*c*, a lens 124, and a color sensor 125. In the color scanner 1, the illuminating lamp 122 illuminates an original document 4 on a platen glass 121 serving as an original document setting table to form an image of the original document 4 on the color sensor 125 through the mirrors 123*a*, 123*b*, and 123*c*, and the lens 124. The original document 4 is scanned by moving an illumination/mirror optical system including the illuminating lamp 122 and mirrors 123*a*, 123*b*, and 123*c*, in a sub-scanning direction. The color sensor 125 reads color image information of the original document 4, for example, for each separated color light component blue (B), green (G), and red (R) as three primary colors in a CIE standard calorimetric system, and converts the color image information to electrical image signals.

The color sensor 125 includes a color separating device that separates received light into (B), (G), (R) colors, and a photoelectric conversion device such as a charge coupled device (CCD), which reads three colors simultaneously. Respective (B), (G), (R) image signals produced by the color sensor 125 are subjected to color conversion processing in an image processing unit (not shown) based on their respective intensity levels. The color conversion processing results in color image data including black (Bk), cyan (C), magenta (M), and yellow (Y).

Specifically, the color scanner 1 receives a start signal that is synchronous with an operation of the color printer 2, then starts scanning the original document 4 by moving the illumination/mirror optical system including the illuminating lamp 122 and mirrors 123*a*, 123*b*, and 123*c*, in a sub-scanning direction. The color scanner 1 obtains image data for one color from an image processing unit (not shown) each time the illumination/mirror optical system scans the original document 4. By repeating the above-described operations four times, image data for respective (Bk), (C), (M), (Y) colors are sequentially obtained from the image processing unit.

Each time when the color scanner 1 obtains one of the (Bk), (C), (M), (Y) image data from the image processing unit, the color scanner 1 sends the data to the color printer 2. The color printer 2 forms a corresponding color toner image synchronously with receiving one of the (Bk), (C), (M), and (Y) data, and repeats the image forming operation four times, and superimposes each color toner image to form a four color toner image.

The color printer 2 includes a drum-shaped photoreceptor 200 as an image bearing member, an image writing device 220 as an exposing device that exposes the surface of the photoreceptor 200, a revolver developing device 230 as a developing device, an intermediate transfer unit 5 and a secondary transfer unit 6 as a transfer device, and a fixing apparatus 7.

The image writing device 220 employs an optical writing unit that converts color image data received from the color scanner 1 through the image processing unit (not shown) into optical signals, and exposes the photoreceptor 200 with the optical signals to form a latent image corresponding to the image of the original document 4.

The optical writing unit as the image writing device 220 includes a laser diode 221 as a light emitting device, a light emission driving controller (not shown) that controls emission and driving of the laser diode 221 in accordance with color image data from the image processing unit (not shown), a polygonal mirror 222 as a scanning device, a motor 223 for driving the polygonal mirror 222, an f-theta lens 224 and a reflecting mirror 225. The light emission driving of the laser diode 221 is controlled by the light emission driving controller (not shown) in accordance with color image data from the image processing unit (not shown). Then, the laser diode 221 converts the color image data into light signals (laser light) and emits laser light. The laser light emitted from the laser diode 221 is deflected by the polygonal mirror 222 and irradiates the surface of the photoreceptor 200 as an exposing light through the f-theta lens 224 and the reflecting mirror 225.

The photoreceptor 200 is driven to rotate in a counter-clockwise direction indicated by an arrow in FIG. 1 by a drive motor (not shown). Arranged around the photoreceptor 200 are a discharging device 202 that discharges the surface of the photoreceptor 200, a photoreceptor cleaning unit 203 that includes a brush and a blade for cleaning the photoreceptor 200, a charging device 201 that charges the photoreceptor 200, an electric potential sensor 204 that measures a surface electric potential of the photoreceptor 200, the revolver-developing device 230 that develops an electrostatic latent image on the photoreceptor 200 with developer, a developer concentration pattern detector 205 that detects the concentration of a developer concentration pattern on the photoreceptor 200, and the intermediate transfer unit 5.

The revolver-developing device 230 includes a black-developing unit 231K, a cyan-developing unit 231C, a magenta-developing unit 231M, a yellow-developing unit 231Y, and a rotation driving unit (not shown) for rotating the revolver-developing device 230. The black-developing unit 231K, the cyan-developing unit 231C, the magenta-developing unit 231M, and the yellow-developing unit 231Y develop electrostatic latent images on the photoreceptor 200 with each color toner to form black, cyan, magenta, and yellow toner images, respectively.

Each of the color-developing units 231K, 231C, 231M, and 231Y includes a developing sleeve (not shown) as a rotating developer carrier that forms thereupon a brush of developer to contact the surface of the photoreceptor 200 for developing the electrostatic latent image on the photoreceptor 200 with toner. Each of the color-developing units 231K, 231C, 231M, and 231Y further includes a developing paddle (not shown) that rotates to pump up and agitate the developer, and a developing sleeve driving unit (not shown) that drives the developing sleeve to rotate in a clockwise direction.

Each of the color-developing units 231K, 231C, 231M, and 231Y uses developer such as two-component color developer-mix, e.g., a mixture of ferrite carrier powder and color toner powder. The two-component color developer-mix in each of the developing units 231K, 231C, 231M, and 231Y is agitated with the developing paddle, so that friction between the toner and the ferrite carrier causes the toner to be negatively charged. Further, a negative DC voltage (DC component) superimposed with an alternative voltage (AC component) is applied to each developing sleeve by a developing bias power supply (not shown) as a developing bias applying device to bias the developing sleeve at a predetermined voltage relative to the metal substrate of the photoreceptor 200.

When the color photocopier is in a waiting condition, the revolver-developing device 230 is set so that the black developing unit 231K is positioned opposite to the photoreceptor 200. When a color copying operation starts upon press on a start switch, the color scanner 1 starts reading an image of an original document, and the image processing unit (not shown) performs the color conversion processing and outputs black image data. The color printer 2 starts to form a latent image on the photoreceptor 200 based on the black image data from the image processing unit with laser light by the image writing device 220. An electrostatic latent image according to black image data is hereinafter referred to as a black latent image. Similarly an electrostatic latent image according to cyan image data, an electrostatic latent image according to magenta image data, and an electrostatic latent image according to yellow image data are referred to as cyan, magenta, and yellow latent images, respectively.

The revolver-developing device 230 is rotated to cause the developing sleeve of the black developing unit 231K to face the photoreceptor 200 before the leading edge of the black latent image on the photoreceptor 200 reaches the developing position of the black developing unit 231K. The developing sleeve of the black developing unit 231K is rotated to develop the black latent image with black toner.

Subsequently, as soon as the trailing edge of the black latent image passes the developing position of the black developing unit 231K, the revolver-developing device 230 is rotated to cause the developing sleeve of the cyan developing unit 231C to face the photoreceptor 200. The above rotation of the revolver-developing device 230 is completed before the leading edge of the cyan latent image on the photoreceptor 200 reaches the developing position of the cyan developing unit 231C. The developing sleeve of the cyan developing unit 231C is rotated to develop the cyan latent image with cyan toner. Following the black and cyan developing process, the rotation of the revolver-developing device 230 for similar developing process for magenta and yellow is repeated subsequently.

The intermediate transfer unit 5 includes an intermediate transfer belt 501 as an intermediate transfer member that is spanned around a plurality of rollers. The photoreceptor 200 and a secondary transfer belt 601 as a transfer member of the secondary transfer unit 6 are arranged around the intermediate transfer belt 501, each being opposed to the intermediate transfer belt 501.

A primary transfer part 101 where a toner image on the photoreceptor 200 is transferred onto the intermediate transfer belt 501 is formed at a position where the intermediate transfer belt 501 and the photoreceptor 200 oppose each other. Further, a secondary transfer part 100 where a toner image on the intermediate transfer belt 501 is transferred onto a transfer sheet 9 as a recording material is formed at a position where the intermediate transfer belt 501 and the secondary transfer belt 601 oppose each other. With the above-described construction, each color toner image formed on the photoreceptor 200 is transferred and superimposed onto the intermediate transfer belt 501 at the primary transfer part 101. Then, a multi-color toner image formed on the intermediate transfer belt 501 is collectively transferred onto the transfer sheet 9 at the secondary transfer part 100.

At an upstream side of the secondary transfer part 100, a pair of registration rollers 209 are arranged to convey the transfer sheet 9 fed out from the sheet feeding bank 3 or a manual sheet feeding tray 210 to the secondary transfer part 100 at a predetermined timing.

A sheet conveying belt 211 is arranged between the secondary transfer unit 6 and the fixing apparatus 7 so as to convey the transfer sheet 9 carrying a multi-color toner image to the fixing apparatus 7. The sheet conveying belt 211 is spanned around a pair of rollers, one of which is a drive roller. Between the fixing apparatus 7 and a left side platen of a main body 2*a* of the color photocopier, a sheet discharging unit 212 including a pair of sheet discharging rollers is provided. The sheet discharging unit 212 discharges the transfer sheet 9, which has passed through the fixing apparatus 7, from the main body 2*a*.

Further, an intermediate tray 207 for use in both sides printing is arranged below the sheet conveying belt 211. The transfer sheet 9 which has passed through the fixing apparatus 7 is conveyed into the intermediate tray 207 when images are printed on both sides of the transfer sheet 9. The transfer sheet 9 conveyed into the intermediate tray 207 is re-fed to the registration roller pair 209 by a sheet feeding roller 208 arranged at one end side of the intermediate tray 207.

In the sheet feeding bank 3, a plurality of sheet feeding trays 300*a*, 300*b*, and 300*c* are arranged to accommodate a stack of transfer sheets 9. The transfer sheets 9 accommodated in the respective sheet feeding trays 300*a*, 300*b*, and 300*c* are fed out to the registration roller pair 209 by sheet feeding rollers 301*a*, 301*b*, and 301*c*, respectively, when the color photocopier is in a printing operation. As the transfer sheets 9, so called re-used sheets whose one side are already printed may be employed.

The sheet feeding bank 3 communicates with the color printer 2 via a sheet feeding path 302. The color scanner 1 and the sheet feeding bank 3 have individual constructions relative to the color printer 2, respectively, and are detachably replaceable with alternative units, if necessary. Although the sheet feeding bank 3 in this embodiment includes a plurality of sheet feeding trays, the sheet feeding bank 3 may include only one sheet feeding tray.

Further, the intermediate tray 207 arranged in the color printer 2 may be used at one side printing instead of both sides printing, so that a color photocopier can be constructed without the sheet feeding bank 3.

Furthermore, in this embodiment, the color photocopier includes the color scanner 1 so as to obtain an image of the color original document 4. However, the color photocopier may be constructed without the color scanner 1, for example, as far as multi-color image data or single color image data is obtained from an information process device such as a personal computer, and the image writing device 220 emits laser light corresponding to the multi-color image data or single color image data and exposes the surface of the photoreceptor 200.

At the upstream side of the secondary transfer part 100 (i.e., at a side where the transfer sheet 9 enters the secondary transfer part 100), guide platens 251 are arranged up and down. The guide platens 251 guide the transfer sheet 9 to the secondary transfer part 100 with the transfer sheet 9 brought into close contact with the surface of the intermediate transfer belt 501. The transfer sheet 9 onto which a toner image is transferred from the intermediate transfer belt 501 at the secondary transfer part 100 is conveyed to the sheet discharging unit 212 via the secondary transfer belt 601 and the sheet conveying belt 211.

Figure 2:
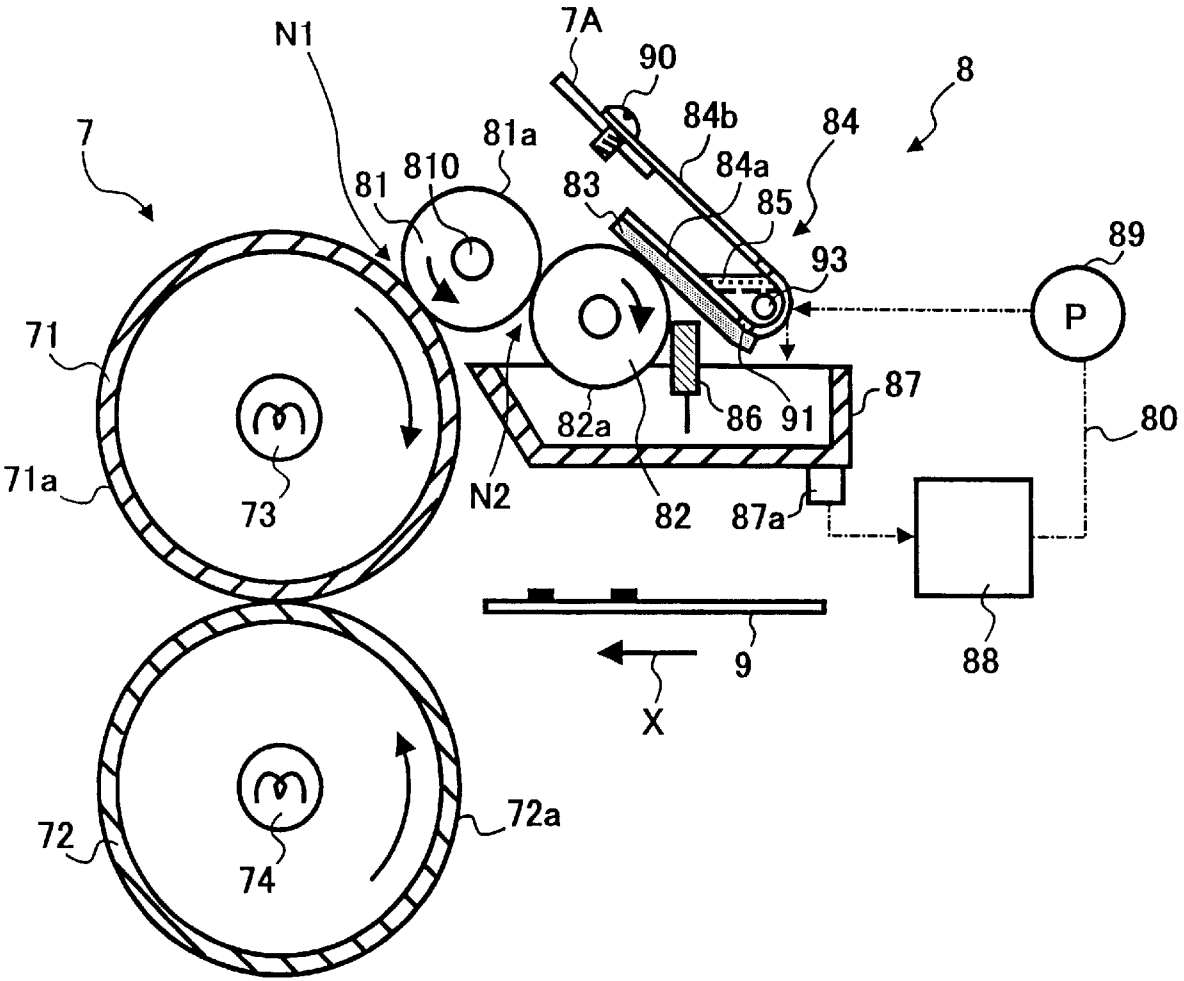
FIG. 2 is an enlarged schematic cross sectional view of the fixing apparatus of FIG. 1.

The fixing apparatus 7 is arranged on a sheet conveying path 150 between the secondary transfer part 100 and the sheet discharging unit 212. As illustrated in FIGS. 1 and 2, the fixing apparatus 7 includes a fixing roller 71 as a fixing member arranged on the sheet conveying path 150, a pressing roller 72 as a pressing member, whose outer circumferential surface 72*a* press-contacts an outer circumferential surface 71*a* of the fixing roller 71, and a toner releasing agent applying device 8 that conveys and applies toner releasing agent onto the outer circumferential surface 71*a* of the fixing roller 71. In this embodiment, the toner releasing agent applying device 8 employs toner releasing agent such as silicone oil. For the sake of clarity, the toner releasing agent applying device 8 will be hereinafter referred to as an oil applying device, and toner releasing agent will be hereinafter referred to as oil.

The fixing roller 71 includes a silicone rubber layer of about 0.5 mm through 3 mm in thickness on a surface of a metal pipe made of aluminum, steel, or other similar metal. Further, the surface of the silicone rubber layer is coated with fluoro rubber of about 30 $\mu$m in thickness. Moreover, another silicone rubber layer of about 50 $\mu$m through 500 $\mu$m in thickness coats the fluoro rubber. A rotation driving force is transmitted to the fixing roller 71 from a driving mechanism (not shown), thereby the fixing roller 71 is driven to rotate in an arrow direction in FIG. 2. In this embodiment, because silicone rubber has a property of swelling by silicone oil, the lowermost silicone rubber layer is prevented from being swelled by oil by providing a silicone oil-resisting fluoro rubber layer on the lowermost silicone rubber layer.

The pressing roller 72 includes a metal pipe coated with a silicone rubber layer, and is rotatably supported by a frame (not shown). The pressing roller 72 is configured to be rotated by rotation of the fixing roller 71.

Arranged inside of the fixing roller 71 and the pressing roller 72 are heaters 73 and 74 as heating members for heating the fixing roller 71 and the pressing roller 72, respectively. Respective surface temperatures of the fixing roller 71 and the pressing roller 72 are detected by a temperature detecting device such as a temperature detecting sensor (not shown). The heaters 73 and 74 are electrically connected to a temperature adjusting circuit (not shown). The temperature adjusting circuit performs on/off control of the heaters 73 and 74 based on the surface temperature detected by the temperature detecting sensor. With the on/off control, the respective surface temperatures of the fixing roller 71 and the pressing roller 72 are held at a predetermined temperature.

Referring to FIG. 2, the oil applying device 8 includes oil applying rollers 81 and 82 as oil applying members which apply oil 85 onto the outer circumferential surface 71*a* of the fixing roller 71, an oil holding unit 84 that holds the oil 85 therein, and a platen-like felt member 83 as a permeable oil delivering member that delivers the oil 85 in the oil holding unit 84 to an outer circumferential surface 82*a* of the oil applying roller 82. As described above, silicone oil is employed as the oil 85, for example.

The oil applying roller 81 whose surface layer is coated with silicone rubber is arranged such that an outer circumferential surface 81*a* of the oil applying roller 81 contacts the outer circumferential surface 71*a* of the fixing roller 71. The oil applying roller 82 is arranged such that its outer circumferential surface 82*a* contacts the outer circumferential surface 81*a* of the oil applying roller 81. In the vicinity of the outer circumferential surface 82*a* of the oil applying roller 82, a blade 86 is arranged so as to regulate and uniform the layer thickness of the oil 85 applied onto the surface of the oil applying roller 82 from the felt member 83. The oil applying roller 82 is driven to rotate by a driving mechanism (not shown) at about one-third of the circumferential velocity of the fixing roller 71, thereby the amount of oil 85 applied onto the oil applying roller 81 is regulated.

If the oil applying roller 82 directly contacts the fixing roller 71, respective surface layers of the oil applying roller 82 and the fixing roller 71 may be deteriorated due to velocity difference between the oil applying roller 82 and the fixing roller 71. For this reason, the oil applying roller 81 is interposed between the oil applying roller 82 and the fixing roller 71.

The oil applying roller 81, which contacts both the fixing roller 71 and the oil applying roller 82, is rotatably supported by a support axis 810, and is configured to be rotated by rotations of the fixing roller 71 and the oil applying roller 82. With this configuration, the oil applying roller 81 is rotated at about two-third of the circumferential velocity of the fixing roller 71, and thereby velocity difference between the fixing roller 71 and the oil applying roller 82 is decreased.

Due to the velocity difference between the fixing roller 71 and the oil applying roller 81, and the velocity difference between the oil applying roller 81 and the oil applying roller 82, slips occur at a nip part N1 where the fixing roller 71 contacts or preferably press-contacts the oil applying roller 81, and at a nip part N2 where the oil applying roller 82 contacts or preferably press-contacts the oil applying roller 81. Because the layer thickness of the oil 85 delivered to the oil applying roller 82 is regulated by the blade 86, and is further uniformed at the nip parts N2 and N1, the oil 85 can be uniformly applied onto the fixing roller 71 from the oil applying roller 81.

Figure 4:
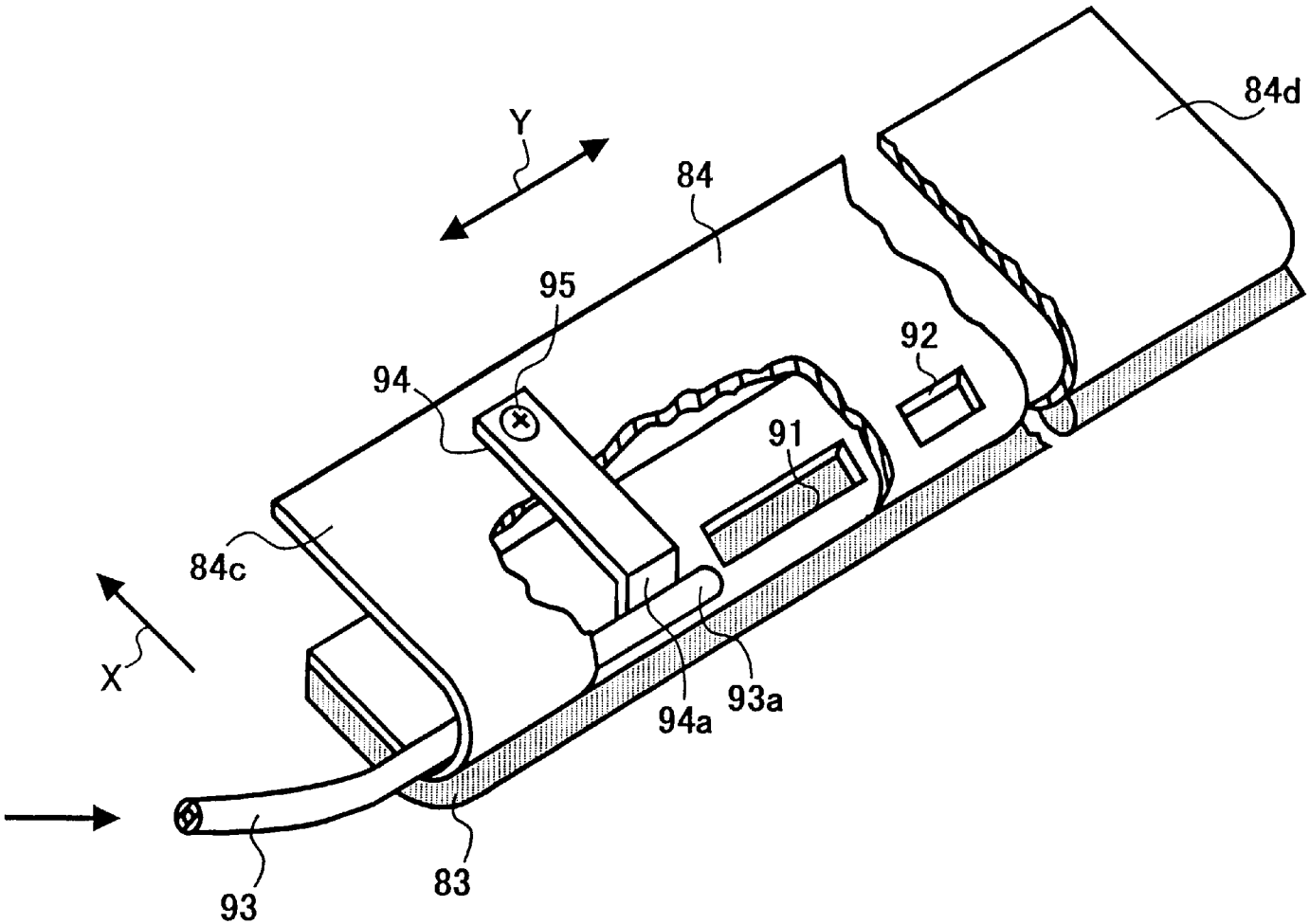
FIG. 4 is a perspective schematic view of the oil holding unit of FIGS. 2 and 3.

The oil holding unit 84 is arranged substantially horizontally at a side of the oil applying roller 82 such that the oil holding unit 84 opposes the outer circumferential surface 82*a* at a predetermined distance. As illustrated in FIG. 4, the oil holding unit 84 extends in a width direction Y of the transfer sheet 9 (hereinafter may be referred to as an extending direction Y) which is perpendicular to a transfer sheet conveying direction indicated by arrow X in FIG. 4. The oil holding unit 84 is constructed to be in substantially U shape as viewed from the extending direction Y in FIG. 4. The above-described substantially U shape of the oil holding unit 84 includes V shape or concave shape.

The oil holding unit 84 includes a bent portion at a lower part thereof, and both open side portions 84*c* and 84*d*. The oil holding unit 84 is held to a casing 7A (illustrated in FIGS. 1 and 2) of the fixing apparatus 7 with a screw 90 such that both open side portions 84*c* and 84*d* are positioned in the extending direction Y. With this configuration, the oil holding unit 84 forms an oil flow path. In this embodiment, the oil holding unit 84 is formed from a resilient member such as a leaf spring of substantially U-shape.

Figure 3:
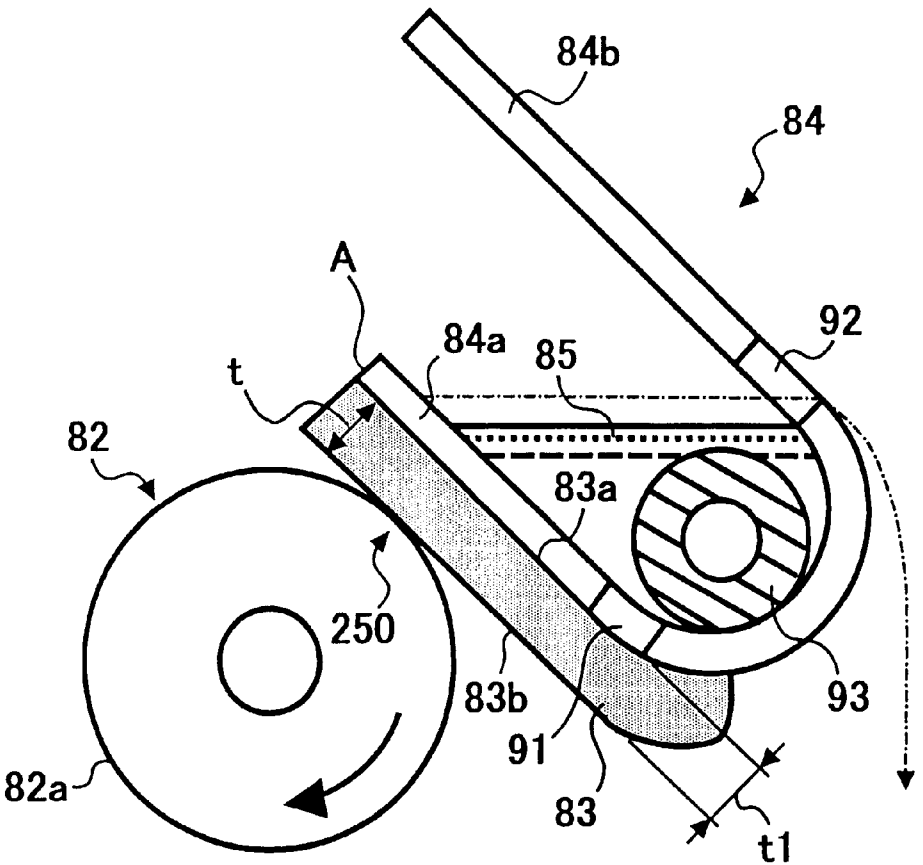
FIG. 3 is an enlarged schematic cross sectional view of a construction in a vicinity of an oil holding unit of an oil applying device according to the embodiment of the present invention.
Figure 6:
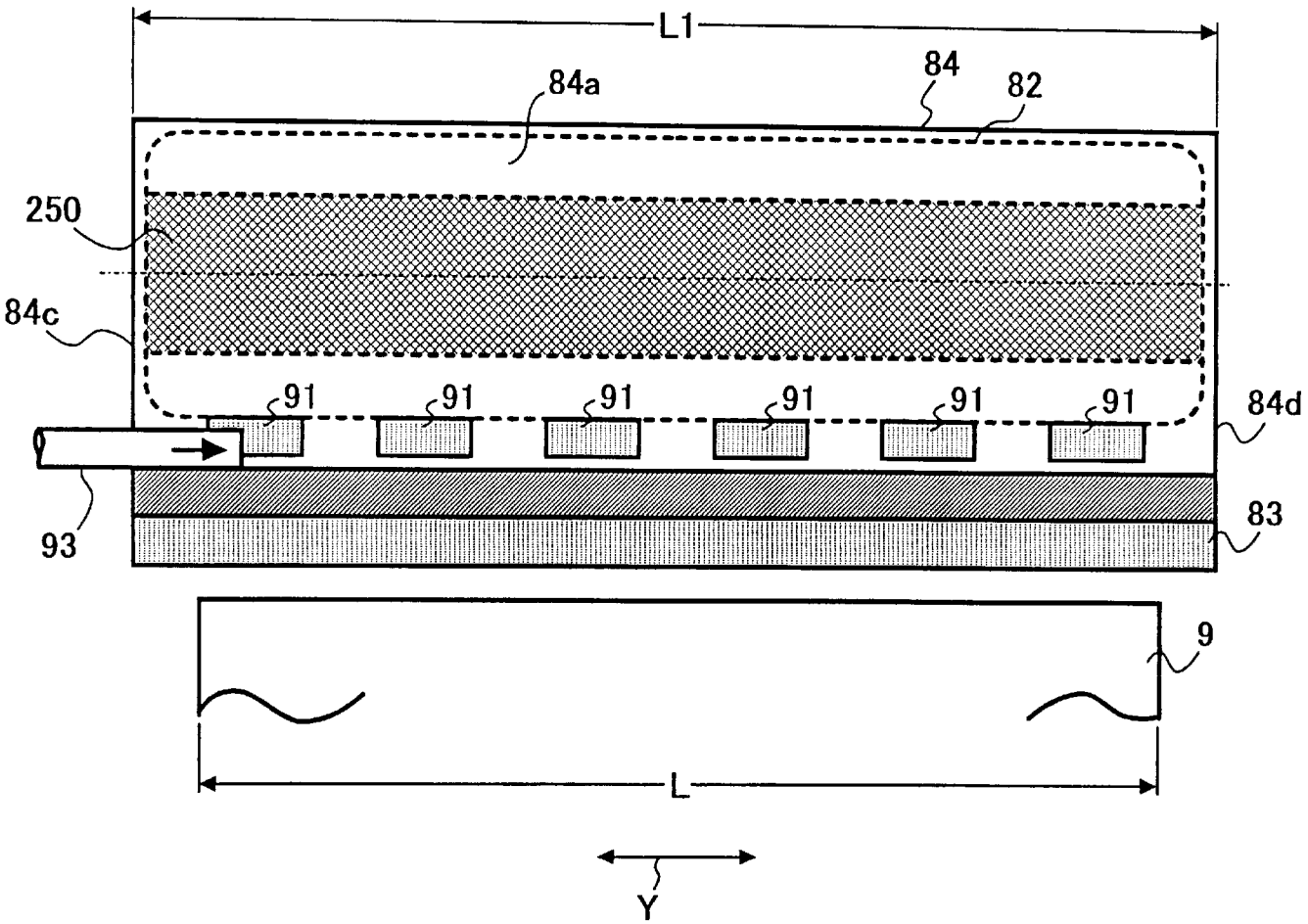
FIG. 6 is a schematic cross sectional view of a construction of the oil holding unit.

As illustrated in FIGS. 3 and 6, a plurality of oil supply openings 91 are formed on a first wall part 84*a* of the oil holding unit 84, which is opposite to the oil applying roller 82, in the extending direction Y. The oil supply openings 91 are formed at the lower part of the first wall part 84*a* which is flat and outside of the bent portion of the oil holding unit 84. As alternative to a plurality of the oil supply openings 91, one oil supply opening of long hole shape extending in the extending direction Y may be employed. However, plural oil supply openings are preferable in view of securing resilience and rigidity of the oil holding unit 84. The oil holding unit 84 is provided such that the first wall part 84*a* inclines in an approaching direction toward the outer circumferential surface 82*a* of the oil applying roller 82.

As illustrated in FIG. 3, an end surface 83*a* of the felt member 83 is attached to an outer surface of the first wall part 84*a* facing the oil applying roller 82 with an adhesive member such as a double-stick tape. The end surface 83*a* of the felt member 83 faces the inside of the oil holding unit 84 through the oil supply openings 91, and is supplied with the oil 85 from the oil holding unit 84 through the oil supply openings 91. The felt member 83 is arranged between the oil applying roller 82 and the oil holding unit 84 such that the end surface 83*a* of the felt member 83 adheres to the first wall part 84*a*, and such that another end surface 83*b* of the felt member 83 opposing the oil applying roller 82 contacts the outer circumferential surface 82*a* of the oil applying roller 82.

As illustrated in FIGS. 3 and 6, a contact part 250 of the end surface 83*b* of the felt member 83 and the outer circumferential surface 82*a* of the oil applying roller 82, and the oil supply openings 91 are arranged not opposite to each other. Specifically, the contact part 250 is situated above the oil supply openings 91. Because the oil 85 supplied to the felt member 83 through the oil supply openings 91 flows downward, a part of the felt member 83 lower than the oil supply openings 91 is soaked with more oil than an upper part of the felt member 83. Therefore, it is preferably that the contact part 250 of the oil applying roller 82 and the felt member 83 is positioned above the oil supply openings 91 and in an area of the felt member 83 where the oil 85 spreads through the oil supply openings 91. As a result excessive oil supply to the oil applying roller 82 can be prevented.

As illustrated in FIG. 6, a length L1 of the felt member 83 in the extending direction Y is set to be greater than a width L of the transfer sheet 9 of the maximum size used in the color photocopier. In addition, each length of the fixing roller 71, the oil applying rollers 81 and 82 is set to be greater than the width L. In this embodiment, the length of the oil holding unit 84 in the extending direction Y is set to be substantially the same as the length L1 of the felt member 83 in the extending direction Y.

In this embodiment, because the oil holding unit 84 is formed from a resilient member such as a leaf spring, as illustrated in FIG. 3, a thickness "t" of the felt member 83 is somewhat greater than a distance "t1" between the oil applying roller 82 and the outer surface of the wall part 84*a* of the oil holding unit 84, so that the end surface 83*b* of the felt member 83 press-contacts the outer circumferential surface 82*a* of the oil applying roller 82. However, the felt member 83 does not necessarily press-contact the outer circumferential surface 82*a* but may just abut it.

Further, a plurality of oil discharging outlets 92 are formed on a second wall part 84*b* of the oil holding unit 84, which is opposite to the first wall part 84*a*, in the extending direction Y. The oil discharging outlets 92 are formed at a lower part of the second wall part 84*b* than an uppermost end part A of the first wall part 84*a* so as to prevent the oil 85 in the oil holding unit 84 from flowing over the end part A. One oil discharging outlet of long hole shape extending in the extending direction Y may be employed instead of a plurality of the oil discharging outlets 92.

As illustrated in FIG. 4, at one side portion 84*c* of the oil holding unit 84 in the extending direction Y, a tube 93 is arranged as an oil injecting member that injects the oil 85 into the oil holding unit 84. A tip end portion 93*a* of the tube 93 is pressed against the bent portion of the oil holding unit 84 and positioned by a short side 94*a* of an L-shaped stopper 94 attached onto the unit 84 with a screw 95.

As illustrated in FIG. 2, an oil pan 87 is arranged below the oil applying roller 82 so as to receive the excessive oil 85 removed by the blade 86, the oil 85 discharged from the other side portion 84*d* of the oil holding unit 84 after flowing through the oil holding unit 84, and the oil 85 overflowed through the oil discharging outlets 92. An outlet 87*a* of the oil pan 87 is connected to an oil tank 88.

The oil 85 is stored in the oil tank 88. An oil pump 89 which pumps up the oil 85 in the oil tank 88 is connected to the oil tank 88 via a tube 80. Further, the tube 93 is connected to an oil injecting side of the oil pump 89. The oil pump 89 and the tube 93 construct an oil conveying unit.

Further, the oil conveying unit, the oil pan 87, the oil tank 88, the tube 80, and the oil holding unit 84 construct an oil circulation mechanism.

An operation of the fixing apparatus 7 according to the embodiment of the present invention is described.

In this embodiment, a four-color toner image on the intermediate transfer belt 501 is collectively transferred onto the transfer sheet 9 conveyed to the secondary transfer part 100 by the registration roller pair 209 of FIG. 1. Then, the transfer sheet 9 carrying the four-color toner image is conveyed to the fixing apparatus 7, and the four-color toner image is fixed onto the transfer sheet 9 while the transfer sheet 9 passing through the fixing apparatus 7. Subsequently, the transfer sheet 9 having the fixed color toner image is discharged from the main body 2*a* through the sheet discharging unit 212.

In the fixing apparatus 7, upon start of an operation of the color photocopier, the oil pump 89 is actuated, and thereby the oil 85 is pumped up from the oil tank 88 and conveyed to the oil holding unit 84 through the tube 93. As illustrated in FIG. 4, the oil 85 is injected into the oil holding unit 84 through the tube 93 attached to the one side portion 84*c* of the oil holding unit 84. With the arrangement of the tube 93 at the one side portion 84*c*, the oil 85 injected into the oil holding unit 84 flows toward the other side portion 84*d* and is held in the oil holding unit 84 due to its viscosity. While flowing in the oil holding unit 84, the oil 85 spreads in the extending direction Y (i.e., the axial direction of the oil applying roller 82) and is supplied to the felt member 83 through the plurality of oil supply openings 91 arranged in the extending direction Y. With the provision of the plurality of oil supply openings 91 on the first wall part 84*a* of the oil holding unit 84 in the extending direction Y, the oil 85 can be supplied to the felt member 83 evenly in the extending direction Y. The oil 85 thus supplied to the felt member 83 quickly spreads over the felt member 83 by capillary phenomenon around the oil supply openings 91 positioned in the vicinity of the contact part 250 of the felt member 83 and the oil applying roller 82.

Figure 7:
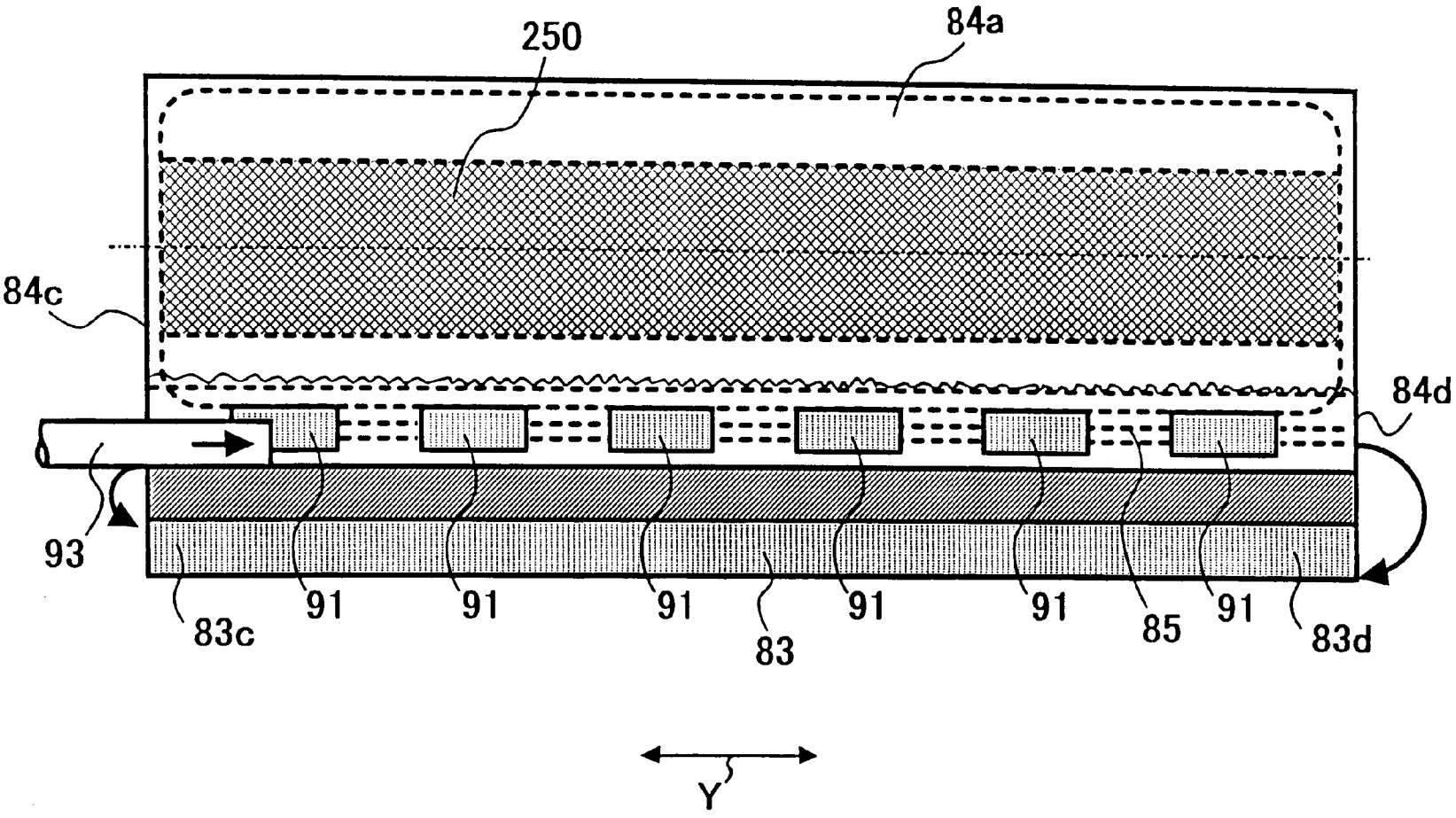
FIG. 7 is a schematic cross sectional view of the oil holding unit illustrating oil flow.

When the oil 85 is held in the oil holding unit 84 to some extent, the oil 85 flows out of the oil holding unit 84 from the other side portion 84*d* due to the fluidity of the oil 85 as indicated by an arrow in FIG. 7. On the other hand, although the oil 85 flowing toward the one side portion 84*c* is somewhat blocked by the tube 93, the oil 85 flows out of the oil holding unit 84 through a gap formed between the tube 93 and the oil holding unit 84. Thereby, both end parts 83*c* and 83*d* of the felt member 83 illustrated in FIG. 7 are soaked with the oil 85 flowing over from the side portions 84*c* and 84*d* of the oil holding unit 84. Because the oil 85 is directly supplied to both end parts 83*c* and 83*d* of the felt member 83 without depending on the capillary phenomenon of the felt member 83, both end parts 83*c* and 83*d* of the felt member 83 are prevented from running out of the oil 85.

Upon start of an operation of the color photocopier, the fixing roller 71 and the oil applying roller 82 are driven to rotate at different speed. With the driving of the fixing roller 71 and the oil applying roller 82, the oil 85 soaked through the felt member 83 is uniformly applied onto the outer circumferential surface 71*a* of the fixing roller 71 via the oil applying rollers 82 and 81.

In the above-described fixing apparatus 7 according to the embodiment of the present invention, because the felt member 83 as one of construction parts of the oil applying device 8 that delivers the oil 85 to the oil applying roller 82 is arranged in the vicinity of the oil holding unit 84 arranged opposite to the oil applying roller 82, an oil supply path from the felt member 83 to the oil applying roller 82 is relatively short compared to one in a background fixing apparatus in which oil is taken up from the oil pan by use of the capillary phenomenon. Further, because the oil 85 is conveyed to the oil holding unit 84 in the vicinity of the oil applying roller 82 by the oil pump 89, the oil supply speed is much increased than in the background fixing apparatus in which oil is taken up from the oil pan by use of the capillary phenomenon. Therefore, the oil 85 can be regularly supplied to the oil applying rollers 82 and 81, and insufficient oil supply and delay of oil supply to the fixing roller 71 are typically avoided. As a result, an offset condition can be obviated, and abrasion of the fixing roller 71 and the pressing roller 72 can be suppressed thereby enhancing the durability of the rollers.

Moreover, according to the embodiment of the present invention, the oil 85 is conveyed to the oil holding unit 84 by the tube 93 arranged at the side part 84*c* of the oil holding unit 84, and the oil 85 is further supplied to the felt member 83 through the plurality of oil supply openings 91 formed in the oil holding unit 84. Thus, the construction for supplying oil 85 to the oil applying roller 82 can be simple.

As described above, because the oil discharging outlets 92 are formed at a lower part of the second wall part 84*b* than the end part A of the first wall part 84*a*, even when the amount of oil 85 is increased in the oil holding unit 84, the oil 85 is discharged from the oil holding unit 84 through the oil discharging outlets 92 before the oil 85 flows over the end part A. If the oil 85 flows over the end part A in the fixing apparatus 7, a large amount of the oil 85 attaches to the oil applying rollers 81 and 82 due to their positional relationship, thereby putting oil marks on the transfer sheet 9. With the above-described provision of the oil discharging outlets 92 in the second wall part 84*b* of the oil holding unit 84, a good quality image without oil marks can be obtained.

Further, because the oil holding unit 84 is provided such that the first wall part 84*a* inclines in an approaching direction toward the outer circumferential surface 82*a* of the oil applying roller 82, even if the amount of oil 85 is small, the surface of the oil 85 relative to the first wall part 84*a* can be risen compared to the oil holding unit 84 provided in an upright position. Therefore, the oil supply openings 91 can be formed at positions of the first wall part 84*a* apart from the bent portion of the oil holding unit 84, and the amount of the oil 85 held in the oil holding unit 84 can be saved.

When the oil supply openings 91 are formed on the first wall part 84*a* outside of the bent portion of the oil holding unit 84, the oil supply openings 91 are surely covered by the felt member 83 in a preferable contact condition. If the oil supply openings 91 are formed in the bent portion of the oil holding unit 84 and contacts the felt member 83 at the bent portion, the felt member 83 is likely to come off. In addition, in a process of making the oil holding unit 84, if the oil supply openings 91 are to be formed in the bent portion of the oil holding unit 84, holes of the oil supply openings 91 formed on a flat platen of the oil holding unit 84 extend when the oil holding unit 84 is bent into a substantially U-shape.

According to the embodiment of the present invention, because the contact part 250 of the felt member 83 and the outer circumferential surface 82*a* of the oil applying roller 82 is provided above the oil supply openings 91 so as not to oppose each other, the contact part 250 is apart from a part of the felt member 83 where the oil 85 is much supplied through the oil supply openings 91. As a result, excessive oil supply to the oil applying roller 82 can be obviated.

Further, as the oil holding unit 84 can be also used as a bracket for attaching the felt member 83, the number of construction parts can be reduced and space saving can be achieved.

The oil pan 87 receives the discharged oil 85. The oil 85 flowing toward the side portions 84*c* and 84*d* in the oil holding unit 84 respectively drops to the oil pan 87 from the side portions 84*c* and 84*d*. Thereby, the spillage of the oil 85 in the apparatus can be prevented. The oil 85 received by the oil pan 87 is collected to the oil tank 88.

Figure 5:
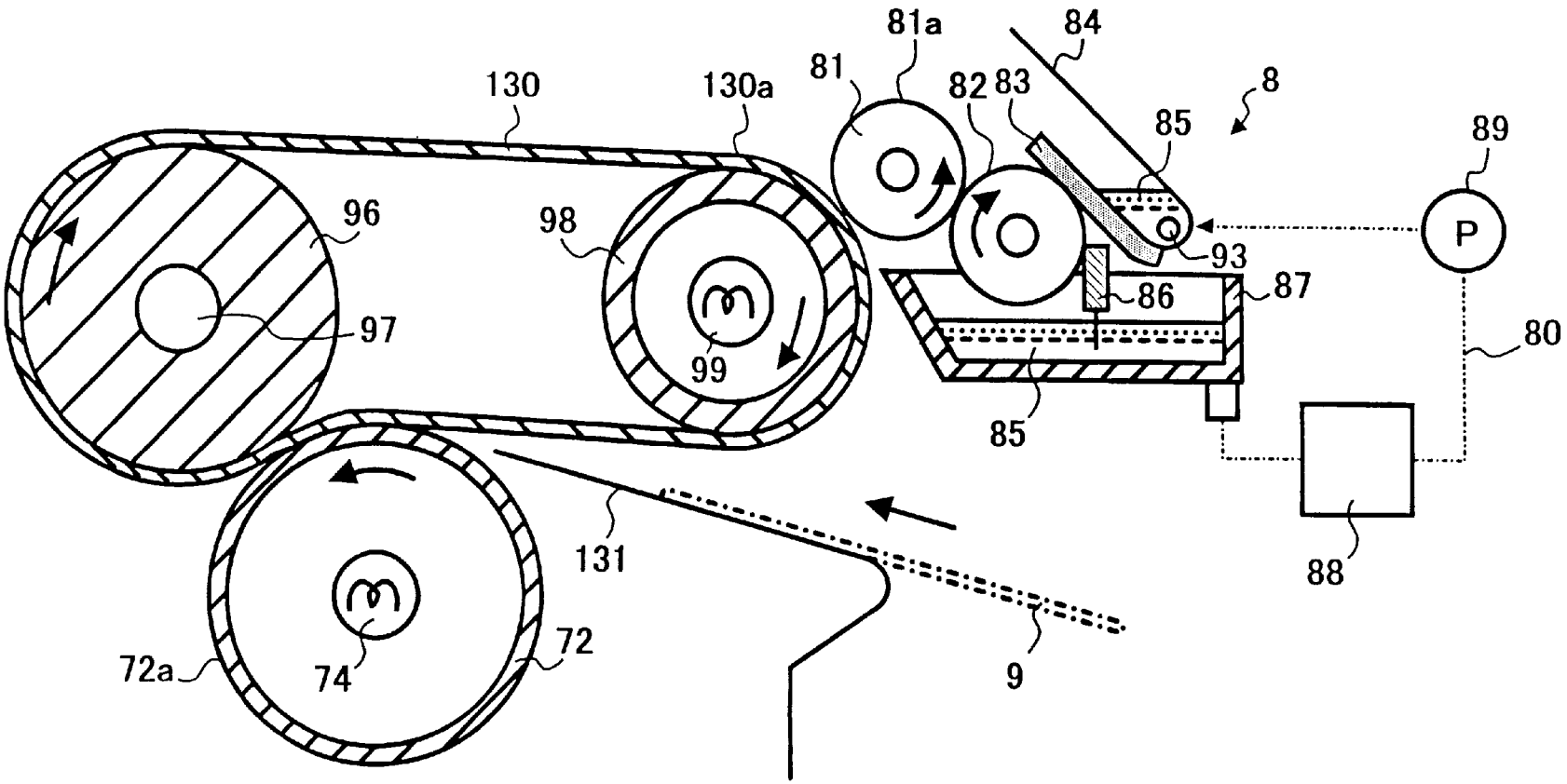
FIG. 5 is an enlarged schematic cross sectional view of an alternative construction of the fixing apparatus.

In the above-described embodiment, the fixing roller 71 is employed as a fixing member. Alternatively, a fixing belt 130 may be used as illustrated in FIG. 5.

The fixing belt 130 is shaped in a form of an endless belt and spanned around a drive roller 96 and a heating roller 98. The drive roller 96 unitarily rotates with a drive shaft 97 to which a rotation drive force is transmitted. The heating roller 98 includes a heater 99 as a heat source therein. A surface 130*a* of the fixing belt 130 contacts the outer circumferential surface 81*a* of the oil applying roller 81 and the outer circumferential surface 72*a* of the pressing roller 72. A reference numeral 131 indicates a guide platen that guides the transfer sheet 9 to a fixing part formed between the fixing belt 130 and the pressing roller 72.

The fixing belt 130 includes a silicone rubber layer of about 0.1 mm through 0.5 mm in thickness on a surface of a belt made of polyimide. In this case, because the silicone rubber layer is thin, thickness variation thereof due to swelling by silicone oil does not tend to occur. For this reason, a fluoro rubber layer, which is provided with the fixing roller 71, is not provided with the fixing belt 130.

In the above-described fixing apparatus employing the fixing belt 130 as a fixing member, because the felt member 83 as one of construction parts of the oil applying device 8 that delivers the oil 85 to the oil applying roller 82 is arranged in the vicinity of the oil holding unit 84 arranged opposite to the oil applying roller 82, an oil supply path from the felt member 83 to the oil applying roller 82 is relatively short compared to one in a background fixing apparatus in which oil is taken up from the oil pan by use of the capillary phenomenon. Further, because the oil 85 is conveyed to the oil holding unit 84 in the vicinity of the oil applying roller 82 by the oil pump 89, the oil supply speed is much increased than in the background fixing apparatus in which oil is taken up from the oil pan by use of the capillary phenomenon. Therefore, the oil 85 can be regularly supplied to the oil applying rollers 82 and 81, and insufficient oil supply and delay of oil supply to the fixing belt 130 are typically avoided. As a result, an offset condition can be obviated, and abrasion of the fixing belt 130 and the pressing roller 72 can be suppressed thereby enhancing their durability.

In the above-described embodiment, the oil 85 is applied onto the fixing roller 71 or the fixing belt 130 via the oil applying rollers 81 and 82. However, the oil applying roller 82 which is directly supplied with the oil 85 from the felt member 83 can be constructed to contact the fixing roller 71 or the fixing belt 130.

Figure 8:
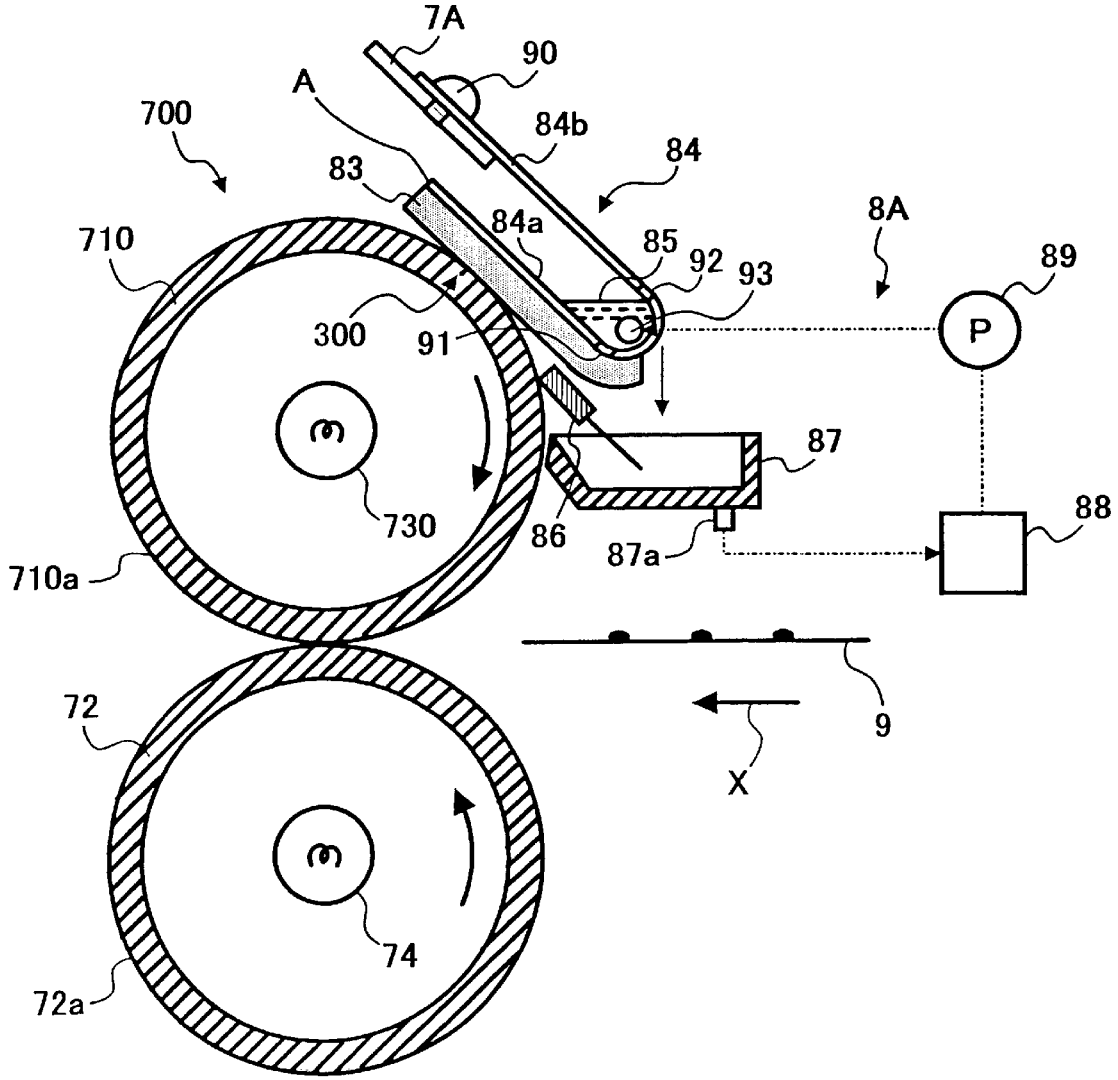
FIG. 8 is an enlarged schematic cross sectional view of a fixing apparatus according to another embodiment of the present invention.
Figure 9:
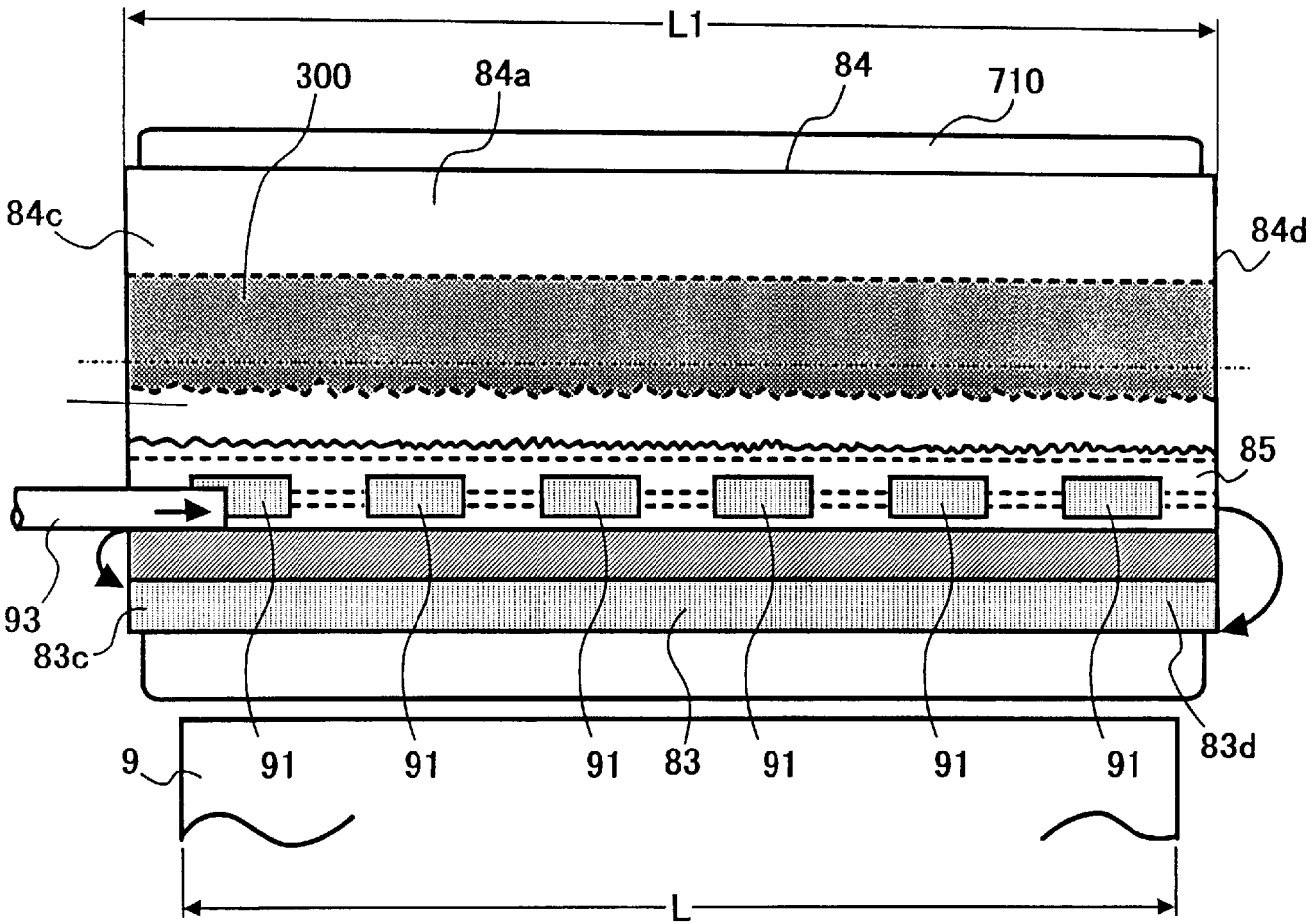
FIG. 9 is a schematic cross sectional view of an oil holding unit of the fixing apparatus of FIG. 8 illustrating oil flow.

Next another embodiment of the present invention is described referring to FIGS. 8 and 9. In this embodiment, a color photocopier includes a fixing apparatus 700 having a different construction. The other parts of the color photocopier are substantially the same as in the color photocopier of FIG. 1, and therefore the description thereof will be omitted.

Similarly as the fixing apparatus 7 of FIG. 1, the fixing apparatus 700 is arranged on the sheet conveying path 150 between the secondary transfer part 100 and the sheet discharging unit 212. The fixing apparatus 700 includes a fixing roller 710 as a fixing member arranged on the sheet conveying path 150, a pressing roller 72 as a pressing member whose outer circumferential surface 72*a* press-contacts an outer circumferential surface 710*a* of the fixing roller 710, and an oil applying device 8A that conveys and applies oil onto the outer circumferential surface 710*a* of the fixing roller 710. The fixing roller 710 includes a heater 730 as a heating member that heats the fixing roller 710.

In the fixing apparatus 700, a felt member 83 as an oil delivering member of the oil applying device 8A directly contacts the outer circumferential surface 710*a* to apply oil 85 thereonto without using the oil applying rollers 81 and 82 of the oil applying device 8 of FIGS. 1 and 2. The oil applying device 8A has a construction similar to the oil applying device 8 of FIGS. 1 and 2 with the exception of the oil applying rollers 81 and 82. For the sake of clarity, the members having substantially the same functions as the ones used in the oil applying device 8 will be designated with the same reference code and their description will be omitted.

The fixing roller 710 includes a surface layer made of a heat-resisting material having a toner releasing property such as fluororesin, fluororubber or other similar material. Such materials have a high friction property as compared to silicone rubber used as a material of the fixing roller 71, and allow the fixing roller 710 to directly contact the felt member 83. The fixing roller 710 includes a silicone rubber layer of about 0.5 mm through 3 mm in thickness on a surface of a metal pipe made of aluminum, steel, or other similar metal. Further, the surface of the silicone rubber layer is covered with a fluororesin tube of about 30 $\mu$m through 150 $\mu$m in thickness. As an alternative to the tube, a fluororesin layer of about 5 $\mu$m through 30 $\mu$m in thickness may be made by spray coating. With the above-described construction of the fixing roller 710, the oil 85 can be applied directly from the felt member 83 onto the outer circumferential surface 710*a*.

In the above-described oil applying device 8A according to the another embodiment of the present invention, the felt member 83, which is attached to the outer surface of a first wall part 84*a* of an oil holding unit 84 on which oil supply openings 91 are formed, is arranged in direct contact with the outer circumferential surface 710*a* of the fixing roller 710. Further, the oil 85 in an oil tank 88 is conveyed and injected into the oil holding unit 84 by an oil conveying device including an oil pump 89 and a tube 93.

The oil holding unit 84 is provided such that the first wall part 84*a* inclines in an approaching direction toward the outer circumferential surface 710*a* of the fixing roller 710. As illustrated in FIG. 8, a contact part 300 of the end surface 83*b* of the felt member 83 and the outer circumferential surface 710*a* of the fixing roller 710, and the oil supply openings 91 are arranged not opposite to each other. Specifically, the contact part 300 is situated above the oil supply openings 91. It is preferable that the contact part 300 of the fixing roller 710 and the felt member 83 is positioned above the oil supply openings 91 and in an area of the felt member 83 where the oil 85 spreads through the oil supply openings 91.

As illustrated in FIG. 9, a length L1 of the felt member 83 in the extending direction Y is set to be greater than a width L of the transfer sheet 9 of the maximum size used in the color photocopier. The length of the fixing roller 710 in the axial direction is set to be greater than the width L.

In this another embodiment, a four-color toner image on the intermediate transfer belt 501 is collectively transferred onto the transfer sheet 9 conveyed to the secondary transfer part 100 by the registration roller pair 209 of FIG. 1. Then, the transfer sheet 9 carrying the four-color toner image is conveyed to the fixing apparatus 700, and the four-color toner image is fixed onto the transfer sheet 9 while the transfer sheet 9 passing through the fixing apparatus 700. Subsequently, the transfer sheet 9 having the fixed color toner image is discharged from the main body 2*a* through the sheet discharging unit 212.

In the fixing apparatus 700, upon start of an operation of the color photocopier, the oil pump 89 is actuated, and thereby the oil 85 is pumped up from the oil tank 88 and conveyed to the oil holding unit 84 through the tube 93. Referring to FIG. 9, the oil 85 is injected into the oil holding unit 84 through the tube 93 attached one side portion 84*c* of the oil holding unit 84. With the arrangement of the tube 93 at the one side portion 84*c*, the oil 85 injected into the oil holding unit 84 flows toward an other side portion 84*d* and is held in the oil holding unit 84 due to its viscosity. While flowing in the oil holding unit 84, the oil 85 spreads in the extending direction Y (i.e., the axial direction of the fixing roller 710) and is supplied to the felt member 83 through the plurality of oil supply openings 91 arranged in the extending direction Y. The oil 85 thus supplied to the felt member 83 quickly spreads over the felt member 83 by capillary phenomenon around the oil supply openings 91 positioned in the vicinity of the contact part 300 of the felt member 83 and the fixing roller 710.

When the oil 85 is held in the oil holding unit 84 to some extent, the oil 85 flows out of the oil holding unit 84 from the other side portion 84*d* due to the fluidity of the oil 85 as indicated by an arrow in FIG. 9. On the other hand, although the oil 85 flowing toward the one side portion 84*c* is somewhat blocked by the tube 93, the oil 85 flows out of the oil holding unit 84 through a gap formed between the tube 93 and the oil holding unit 84. Thereby, both end parts 83*c* and 83*d* of the felt member 83 illustrated in FIG. 9 are soaked with the oil 85 flowing over from the both side portions 84*c* and 84*d* of the oil holding unit 84. As a result, both end parts 83*c* and 83*d* of the felt member 83 are prevented from running out of oil 85.

Upon start of an operation of the color photocopier, the fixing roller 710 is driven to rotate. With the driving of the fixing roller 710, the oil 85 soaked through the felt member 83 is directly and uniformly applied onto the outer circumferential surface 710*a* of the fixing roller 710.

In the above-described fixing apparatus 700 according to the another embodiment of the present invention, because the felt member 83 as one of construction parts of the oil applying device 8A that delivers the oil 85 to the fixing roller 710 is arranged in the vicinity of the oil holding unit 84 arranged opposite to the fixing roller 710, an oil supply path from the felt member 83 to the fixing roller 710 is relatively short compared to one in a background fixing apparatus in which oil is taken up from the oil pan by use of the capillary phenomenon. Further, because the oil 85 is conveyed to the oil holding unit 84 in the vicinity of the fixing roller 710 by the oil pump 89, the oil supply speed is much increased than in the background fixing apparatus in which oil is taken up from the oil pan by use of the capillary phenomenon. Therefore, the oil 85 can be stably supplied to the fixing roller 710, and insufficient oil supply and delay of oil supply to the fixing roller 710 are typically avoided. As a result, an offset condition can be obviated, and abrasion of the fixing roller 710 and the pressing roller 72 can be suppressed thereby enhancing the durability of the rollers.

Moreover, according to the another embodiment of the present invention, the oil 85 is conveyed to the oil holding unit 84 by the tube 93 arranged at the side portions 84*c* of the oil holding unit 84, the oil 85 is further supplied to the felt member 83 through the plurality of oil supply openings 91 formed in the oil holding unit 84. Thus, the construction for supplying oil 85 to the oil applying roller 82 can be simple.

Because oil discharging outlets 92 are formed at a lower part of a second wall part 84*b* than the end part A of the first wall part 84*a*, even when the amount of oil 85 is increased in the oil holding unit 84, the oil 85 is discharged from the oil holding unit 84 through the oil discharging outlets 92 before the oil 85 flows over the end part A. If the oil 85 flows over the end part A in the fixing apparatus 700, a large amount of the oil 85 attaches to the fixing roller 710 due to its positional relationship, thereby putting oil marks on the transfer sheet 9. With the above-described provision of the oil discharging outlets 92 in the second wall part 84*b* of the oil holding unit 84, a good quality image without oil marks can be obtained.

Further, because the oil holding unit 84 is provided such that the first wall part 84*a* inclines in an approaching direction toward the outer circumferential surface 710*a* of the fixing roller 710, even if the amount of oil 85 is small, the surface of the oil 85 relative to the first wall part 84*a* can be risen compared to the oil holding unit 84 provided in an upright position. Therefore, the oil supply openings 91 can be formed at positions of the first wall part 84*a* apart from the bent portion of the oil holding unit 84, and the amount of the oil 85 held in the oil holding unit 84 can be saved.

When the oil supply openings 91 are formed on the first wall part 84*a* outside of the bent portion of the oil holding unit 84, the oil supply openings 91 are surely covered by the felt member 83 in a preferable contact condition. If the oil supply openings 91 are formed in the bent portion of the oil holding unit 84 and contacts the felt member 83 at the bent portion, the felt member 83 is likely to come off. In addition, in a process of making the oil holding unit 84, if the oil supply openings 91 are to be formed in the bent portion of the oil holding unit 84, holes of the oil supply openings 91 formed on a flat platen of the oil holding unit 84 extend when the oil holding unit 84 is bent into a substantially U-shape.

According to the another embodiment of the present invention, because the contact part 300 of the felt member 83 and the outer circumferential surface 710*a* of the fixing roller 710 is provided above the oil supply openings 91 so as not to oppose each other, the contact part 300 is apart from a part of the felt member 83 where the oil 85 is supplied through the oil supply openings 91. As a result, excessive oil supply to the fixing roller 710 can be obviated.

The present invention has been described with respect to the embodiments illustrated in the figures. However, the present invention is not limited to these embodiments and may be practiced otherwise.

In this another embodiment, the felt member 83 directly contacts the outer circumferential surface 710*a* of the fixing roller 710. Alternatively, a fixing belt like the one illustrated in FIG. 5 may directly contact the felt member 83 instead of the fixing roller 710. In this case, the fixing belt includes a silicone rubber layer of about 0.1 mm through 0.5 mm in thickness on a surface of a belt made of polyimide. Further, the surface of the silicone rubber layer is covered with a fluororesin tube of about 30 $\mu$m through 150 $\mu$m in thickness. As an alternative to the tube, a fluororesin layer of about 5 $\mu$m through 30 $\mu$m in thickness may be made by spray coating, or fluororesin may be directly provided on the surface of the belt made of polyimide. With the above-described construction of the fixing belt, the oil 85 can be applied directly from the felt member 83 onto the fixing belt.

Although two oil applying rollers 81 and 82 are used as oil applying member in the oil applying device 8 of the fixing apparatus 7, at least one oil applying roller (i.e., one oil applying roller or more) can be employed to apply oil onto a fixing member.

In the above-described embodiments of the present invention, the oil applying devices 8 and 8A are configured such that the oil 85 is injected into the oil holding unit 84 through the tube 93 arranged at the one side portion 84*c* of the oil holding unit 84 provided substantially horizontally, and the oil 85 injected into the oil holding unit 84 spreads over in the extending direction Y and flows out of the oil holding unit 84 from the both side portions 84*c* and 84*d*. However, the configuration of the oil applying devices 8 and 8A is not limited to the one described above.

For example, if an oil supply to the end part 83*c* of the felt member 83 can be secured by arranging the tube 93 at a position closer to the one side portion 84*c* of the oil holding unit 84, flow of the oil 85 toward the one side portion 84*c* may be blocked by the tube 93, 50 that the oil 85 may be caused to flow toward the other side portion 84*d*. As another non-limiting alternative configuration, the oil holding unit 84 may be arranged such that the one side portion 84*c* is higher than the other side portion 84*d*, thereby causing the oil 85 to flow actively toward the other side portion 84*d*. With the above-described configurations, the tube 93 can be arranged with numerous layouts.

The present invention has been described with respect to the color photocopier as an example of an image forming apparatus. However, it is needless to say that the present invention can be applied to other image forming apparatuses such as a printer or a facsimile machine.

Further, the order of forming images of respective colors and/or the arrangement of the developing units for respective colors are not limited to the ones described above and can be practiced otherwise.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-315041 filed in the Japanese Patent Office on Oct. 16, 2000, and Japanese Patent Application No. 2001-273354 filed in the Japanese Patent Office on Sep. 10, 2001, and the entire contents of each of which are hereby incorporated herein by reference.

What is claimed as new and is desired to be secured by Letters Patent of the United States is:

1. A fixing apparatus for fixing a toner image on a recording material, comprising:

a fixing member arranged on a recording material conveying path;

a pressing member configured to press-contact a surface of the fixing member; and a toner releasing agent applying device configured to convey and apply toner releasing agent onto the surface of the fixing member, the toner releasing agent applying device comprising, a toner releasing agent holding unit configured to hold toner releasing agent and including a toner releasing agent supply opening;

a permeable toner releasing agent delivering member configured to deliver toner releasing agent from the toner releasing agent holding unit to the surface of the fixing member via a contact part on the toner releasing agent delivering member, the toner releasing agent delivering member being supplied with the toner releasing agent in the toner releasing agent holding unit through the toner releasing agent supply opening, the contact part being arranged in an offset relationship from the toner releasing agent supply opening; and a toner releasing agent conveying unit configured to convey toner releasing agent to the toner r leasing agent holding unit.

2. The fixing apparatus according to claim 1, wherein:

the toner releasing agent holding unit is arranged in a vicinity of the fixing member and opposite to the fixing member at a distance apart, the toner releasing agent delivering member is arranged between the toner releasing agent holding unit and the fixing member, and the toner releasing agent delivering member includes a first end surface which contacts the fixing member, and a second end surface opposing the first end surface and facing an inside of the toner releasing agent holding unit through the toner releasing agent supply opening.

3. The fixing apparatus according to claim 2, wherein a contact part of the toner releasing agent delivering member and the fixing member is not opposite to the toner releasing agent supply opening.

4. The fixing apparatus according to claim 3, wherein the contact part of the toner releasing agent delivering member and the fixing member is arranged above the toner releasing agent supply opening.

5. The fixing apparatus according to claim 1, wherein:

the toner releasing agent applying device further comprises at least one toner releasing agent applying member configured to apply toner releasing agent onto the surface of the fixing member, the toner releasing agent holding unit is arranged in a vicinity of the at least one toner releasing agent applying member and opposite to the at least one toner releasing agent applying member at a distance apart, the toner releasing agent delivering member is arranged between the toner releasing agent holding unit and the at least one toner releasing agent applying member, and the toner releasing agent delivering member includes a first end surface which contacts the at least one toner releasing agent applying member, and a second end surface opposing the first end surface and facing an inside of the toner releasing agent holding unit through the toner releasing agent supply opening.

6. The fixing apparatus according to claim 5, wherein a contact part of the toner releasing agent delivering member and the at least one toner releasing agent applying member is not opposite to the toner releasing agent supply opening.

7. The fixing apparatus according to claim 6, wherein the contact part of the toner releasing agent delivering member and the at least one toner releasing agent applying member is arranged above the toner releasing agent supply opening.

8. The fixing apparatus according to claim 1, wherein the toner releasing agent holding unit forms a toner releasing agent flow path which opens at both side parts of the toner releasing agent holding unit positioned in a width direction of the recording material.

9. The fixing apparatus according to claim 1, wherein the toner releasing agent is oil.

10. The fixing apparatus according to claim 1, wherein the toner releasing agent holding unit is formed from a resilient member.

11. A fixing apparatus for fixing a toner image on a recording material, comprising:

a fixing member arranged on a recording material conveying path;

a pressing member configured to press-contact a surface of the fixing member; and a toner releasing agent applying device configured to convey and apply toner releasing agent onto the surface of the fixing member, the toner releasing agent applying device comprising, a toner releasing agent holding unit configured to hold toner releasing agent and including a toner releasing agent supply opening;

a permeable toner releasing agent delivering member configured to deliver toner releasing agent from the toner releasing agent holding unit to the surface of the fixing member, the toner releasing agent delivering member being supplied with the toner releasing agent in the toner releasing agent holding unit through the toner releasing agent supply opening; and a toner releasing agent conveying unit configured to convey toner releasing agent to the toner releasing agent holding unit, wherein:

the toner releasing agent applying device further comprises at least one toner releasing agent applying member configured to apply toner releasing agent onto the surface of the fixing member, the toner releasing agent holding unit is arranged in a vicinity of the at least one toner releasing agent applying member and opposite to the at least one toner releasing agent applying member at a distance apart, the toner releasing agent delivering member is arranged between the toner releasing agent holding unit and the at least one toner releasing agent applying member, the toner releasing agent delivering member includes a first end surface which contacts the at least one toner releasing agent applying member, and a second end surface opposing the first end surface and facing an inside of the toner releasing agent holding unit through the toner releasing agent supply opening, the at least one toner releasing agent applying member includes a plurality of toner releasing agent applying members, and the at least one of the plurality of toner releasing agent applying members contacts the first end surface of the toner releasing agent delivering member, and the at least another one of the plurality of toner releasing agent applying members contacts the surface of the fixing member.

12. A fixing apparatus for fixing a toner image on a recording material, comprising:

a fixing member arranged on a recording material conveying path;

a pressing member configured to press-contact a surface of the fixing member; and a toner releasing agent applying device configured to convey and apply toner releasing agent onto the surface of the fixing member, the toner releasing agent applying device comprising, a toner releasing agent holding unit configured to hold toner releasing agent and including a toner releasing agent supply opening;

a permeable toner releasing agent delivering member configured to deliver toner releasing agent from the toner releasing agent holding unit to the surface of the fixing member, the toner releasing agent delivering member being supplied with the toner releasing agent in the toner releasing agent holding unit through the toner releasing agent supply opening; and a toner releasing agent conveying unit configured to convey toner releasing agent to the toner releasing agent holding unit, wherein:

the toner releasing agent holding unit is arranged in a vicinity of the fixing member and opposite to the fixing member at a distance apart, the toner releasing agent delivering member is arranged between the toner releasing agent holding unit and the fixing member, the toner releasing agent delivering member includes a first end surface which contacts the fixing member, and a second end surface opposing the first end surface and facing an inside of the toner releasing agent holding unit through the toner releasing agent supply opening, the toner releasing agent holding unit extends in a width direction of the recording material, and has substantially a U-shape including a bent portion at a lower part thereof as viewed from an extending direction of the toner releasing agent holding unit, and includes a first wall part opposing the fixing member, and the toner releasing agent supply opening is formed on the first wall part in an extending direction of the toner releasing agent holding unit.

13. The fixing apparatus according to claim 12, wherein a toner releasing agent injecting member configured to inject toner releasing agent into the toner releasing agent holding unit is arranged at one side part of the toner releasing agent holding unit in the extending direction of the toner releasing agent holding unit.

14. The fixing apparatus according to claim 13, wherein the toner releasing agent holding unit is arranged such that the one side part of the toner releasing agent holding unit is higher than the other side part of the toner releasing agent holding unit in the extending direction of the toner releasing agent holding unit.

15. The fixing apparatus according to claim 12, wherein the toner releasing agent holding unit further includes a second wall part opposing the first wall part, and a toner releasing agent discharging outlet configured to discharge toner releasing agent from the toner releasing agent holding unit at a lower part of the second wall part than an uppermost end part of the first wall part.

16. The fixing apparatus according to claim 12, wherein the toner releasing agent holding unit is provided such that the first wall part inclines in an approaching direction toward the fixing member.

17. An image fixing apparatus for fixing a toner image on a recording material, comprising:

a fixing member arranged on a recording material conveying path;

a pressing member configured to press-contact a surface of the fixing member; and a toner releasing agent applying device configured to convey and apply toner releasing agent onto the surface of the fixing member, the toner releasing agent applying device comprising, a toner releasing agent holding unit configured to hold toner releasing agent and including a toner releasing agent supply opening;

a permeable toner releasing agent delivering member configured to deliver toner releasing agent from the toner releasing agent holding unit to the surface of the fixing member, the toner releasing agent delivering member being supplied with the toner releasing agent in the toner releasing agent holding unit through the toner releasing agent supply opening; and a toner releasing agent conveying unit configured to convey toner releasing agent to the toner releasing agent holding unit, wherein:

the toner releasing agent applying device further comprises at least one toner releasing agent applying member configured to apply toner releasing agent onto the surface of the fixing member, the toner releasing agent holding unit is arranged in a vicinity of the at least one toner releasing agent applying member and opposite to the at least one toner releasing agent applying member at a distance apart, the toner releasing agent delivering member is arranged between the toner releasing agent holding unit and the at least one toner releasing agent applying member, the toner releasing agent delivering member includes a first end surface which contacts the at least one toner releasing agent applying member, and a second end surface opposing the first end surface and facing an inside of the toner releasing agent holding unit through the toner releasing agent supply opening, the toner releasing agent holding unit extends in a width direction of the recording material, and has substantially a U-shape including a bent portion at a lower part thereof as viewed from an extending direction of the toner releasing agent holding unit, and includes a first wall part opposing the at least one toner releasing agent applying member, and the toner releasing agent supply opening is formed on the first wall part in an extending direction of the toner releasing agent holding unit.

18. The fixing apparatus according to claim 17, wherein a toner releasing agent injecting member configured to inject toner releasing agent into the toner releasing agent holding unit is arranged at one side part of the toner releasing agent holding unit in the extending direction of the toner releasing agent holding unit.

19. The fixing apparatus according to claim 18, wherein the toner releasing agent holding unit is arranged such that the one side part of the toner releasing agent holding unit is higher than the other side part of the toner releasing agent holding unit in the extending direction of the toner releasing agent holding unit.

20. The fixing apparatus according to claim 17, wherein the toner releasing agent holding unit further includes a second wall part opposing the first wall part, and a toner releasing agent discharging outlet configured to discharge toner releasing agent from the toner releasing agent holding unit at a lower part of the second wall part than an uppermost end part of the first wall part.

21. The fixing apparatus according to claim 17, wherein the toner releasing agent holding unit is provided such that the first wall part inclines in an approaching direction toward the at least one toner releasing agent applying member.

22. An image forming apparatus comprising:

a fixing apparatus for fixing a toner image on a recording material including, a fixing member arranged on a recording material conveying path;

a pressing member configured to press-contact a surface of the fixing member; and a toner releasing agent applying device configured to convey and apply toner releasing agent onto the surface of the fixing member, the toner releasing agent applying device including, a toner releasing agent holding unit configured to hold toner releasing agent and including a toner releasing agent supply opening;

a permeable toner releasing agent delivering member configured to deliver toner releasing agent from the toner releasing agent holding unit to the surface of the fixing member via a contact part on the toner releasing agent delivering member, the toner releasing agent delivering member being supplied with the toner releasing agent in the toner releasing agent holding unit through the toner releasing agent supply opening, the contact part being arranged in an offset relationship from the toner releasing agent supply opening; and a toner releasing agent conveying unit configured to convey toner releasing agent to the toner releasing agent holding unit.

23. The image forming apparatus according to claim 22, wherein:

the toner releasing agent holding unit is arranged in a vicinity of the fixing member and opposite to the fixing member at a distance apart, the toner releasing agent delivering member is arranged between the toner releasing agent holding unit and the fixing member, and the toner releasing agent delivering member includes a first end surface which contacts the fixing member, and a second end surface opposing the first end surface and facing an inside of the toner releasing agent holding unit through the toner releasing agent supply opening.

24. The image forming apparatus according to claim 23, wherein a contact part of the toner releasing agent delivering member and the fixing member is not opposite to the toner releasing agent supply opening.

25. The image forming apparatus according to claim 24, wherein the contact part of the toner releasing agent delivering member and the fixing member is arranged above the toner releasing agent supply opening.

26. The image forming apparatus according to claim 22, wherein:

the toner releasing agent applying device further comprises at least one toner releasing agent applying member configured to apply toner releasing agent onto the surface of the fixing member, the toner releasing agent holding unit is arranged in a vicinity of the at least one toner releasing agent applying member and opposite to the at least one toner releasing agent applying member at a distance apart, the toner releasing agent delivering member is arranged between the toner releasing agent holding unit and the at least one toner releasing agent applying member, and the toner releasing agent delivering member includes a first end surface which contacts the at least one toner releasing agent applying member, and a second end surface opposing the first end surface and facing an inside of the toner releasing agent holding unit through the toner releasing agent supply opening.

27. The image forming apparatus according to claim 26, wherein a contact part of the toner releasing agent delivering member and the at least one toner releasing agent applying member is not opposite to the toner releasing agent supply opening.

28. The image forming apparatus according to claim 27, wherein the contact part of the toner releasing agent delivering member and the at least one toner releasing agent applying member is arranged above the toner releasing agent supply opening.

29. The image forming apparatus according to claim 22, wherein the toner releasing agent holding unit forms a toner releasing agent flow path which opens at both side parts of the toner releasing agent holding unit positioned in a width direction of the recording material.

30. The image forming apparatus according to claim 22, wherein the toner releasing agent is oil.

31. The image forming apparatus according to claim 22, wherein the toner releasing agent holding unit is formed from a resilient member.

32. An image forming apparatus comprising:

a fixing apparatus for fixing a toner image on a recording material including, a fixing member arranged on a recording material conveying path;

a pressing member configured to press-contact a surface of the fixing member; and a toner releasing agent applying device configured to convey and apply toner releasing agent onto the surface of the fixing member, the toner releasing agent applying device including, a toner releasing agent holding unit configured to hold toner releasing agent and including a toner releasing agent supply opening;

a permeable toner releasing agent delivering member configured to deliver toner releasing agent from the toner releasing agent holding unit to the surface of the fixing member, the toner releasing agent delivering member being supplied with the toner releasing agent in the toner releasing agent holding unit through the toner releasing agent supply opening; and a toner releasing agent conveying unit configured to convey toner releasing agent to the toner releasing agent holding unit, wherein:

the toner releasing agent holding unit is arranged in a vicinity of the fixing member and opposite to the fixing member at a distance apart, the toner releasing agent delivering member is arranged between the toner releasing agent holding unit and the fixing member, the toner releasing agent delivering member includes a first end surface which contacts the fixing member, and a second end surface opposing the first end surface and facing an inside of the toner releasing agent holding unit through the toner releasing agent supply opening, the toner releasing agent applying device further comprises at least one toner releasing agent applying member configured to apply toner releasing agent onto the surface of the fixing member, the toner releasing agent holding unit is arranged in a vicinity of the at least one toner releasing agent applying member and opposite to the at least one toner releasing agent applying member at a distance apart, the toner releasing agent delivering member is arranged between the toner releasing agent holding unit and the at least one toner releasing agent applying member, the toner releasing agent delivering member includes a first end surface which contacts the at least one toner releasing agent applying member, and a second end surface opposing the first end surface and facing an inside of the toner releasing agent holding unit through the toner releasing agent supply opening, the at least one toner releasing agent applying member includes a plurality of toner releasing agent applying members and the at least one of the plurality of toner releasing agent applying members contacts the first end surface of the toner releasing agent delivering member, and the at least another one of the plurality of toner releasing agent applying members contacts the surface of the fixing member.

33. An image forming apparatus comprising:

a fixing apparatus for fixing a toner image on a recording material including, a fixing member arranged on a recording material conveying path;

a pressing member configured to press-contact a surface of the fixing member; and a toner releasing agent applying device configured to convey and apply toner releasing agent onto the surface of the fixing member, the toner releasing agent applying device including, a toner releasing agent holding unit configured to hold toner releasing agent and including a toner releasing agent supply opening;

a permeable toner releasing agent delivering member configured to deliver toner releasing agent from the toner releasing agent holding unit to the surface of the fixing member, the toner releasing agent delivering member being supplied with the toner releasing agent in the toner releasing agent holding unit through the toner releasing agent supply opening; and a toner releasing agent conveying unit configured to convey toner releasing agent to the toner releasing agent holding unit, wherein:

the toner releasing agent holding unit is arranged in a vicinity of the fixing member and opposite to the fixing member at a distance apart, the toner releasing agent delivering member is arranged between the toner releasing agent holding unit and the fixing member, the toner releasing agent delivering member includes a first end surface which contacts the fixing member, and a second end surface opposing the first end surface and facing an inside of the toner releasing agent holding unit through the toner releasing agent supply opening, the toner releasing agent holding unit extends in a width direction of the recording material, and has substantially a U-shape including a bent portion at a lower part thereof as viewed from an extending direction of the toner releasing agent holding unit, and includes a first wall part opposing the fixing member, and the toner releasing agent supply opening is formed on the first wall part in an extending direction of the toner releasing agent holding unit.

34. The image forming apparatus according to claim 33, wherein a toner releasing agent injecting member configured to inject toner releasing agent into the toner releasing agent holding unit is arranged at one side part of the toner releasing agent holding unit in the extending direction of the toner releasing agent holding unit.

35. The image forming apparatus according to claim 34, wherein the toner releasing agent holding unit is arranged such that the one side part of the toner releasing agent holding unit is higher than the other side part of the toner releasing agent holding unit in the extending direction of the toner releasing agent holding unit.

36. The image forming apparatus according to claim 33, wherein the toner releasing agent holding unit further includes a second wall part opposing the first wall part, and a toner releasing agent discharging outlet configured to discharge toner releasing agent from the toner releasing agent holding unit at a lower part of the second wall part than an uppermost end part of the first wall part.

37. The image forming apparatus according to claim 33, wherein the toner releasing agent holding unit is provided such that the first wall part inclines in an approaching direction toward the fixing member.

38. An image forming apparatus comprising:

a fixing apparatus for fixing a toner image on a recording material including, a fixing member arranged on a recording material conveying path;

a pressing member configured to press-contact a surface of the fixing member; and a toner releasing agent applying device configured to convey and apply toner releasing agent onto the surface of the fixing member, the toner releasing agent applying device including, a toner releasing agent holding unit configured to hold toner releasing agent and including a toner releasing agent supply opening;

a permeable toner releasing agent delivering member configured to deliver toner releasing agent from the toner releasing agent holding unit to the surface of the fixing member, the toner releasing agent delivering member being supplied with the toner releasing agent in the toner releasing agent holding unit through the toner releasing agent supply opening; and a toner releasing agent conveying unit configured to convey toner releasing agent to the toner releasing agent holding unit, wherein:

the toner releasing agent holding unit is arranged in a vicinity of the fixing member and opposite to the fixing member at a distance apart, the toner releasing agent delivering member is arranged between the toner releasing agent holding unit and the fixing member, the toner releasing agent delivering member includes a first end surface which contacts the fixing member, and a second end surface opposing the first end surface and facing an inside of the toner releasing agent holding unit through the toner releasing agent supply opening, the toner releasing agent applying device further comprises at least one toner releasing agent applying member configured to apply toner releasing agent onto the surface of the fixing member, the toner releasing agent holding unit is arranged in a vicinity of the at least one toner releasing agent applying member and opposite to the at least one toner releasing agent applying member at a distance apart, the toner releasing agent delivering member is arranged between the toner releasing agent holding unit and the at least one toner releasing agent applying member, the toner releasing agent delivering member includes a first end surface which contacts the at least one toner releasing agent applying member, and a second end surface opposing the first end surface and facing an inside of the toner releasing agent holding unit through the toner releasing agent supply opening, the toner releasing agent holding unit extends in a width direction of the recording material, and has substantially a U-shape including a bent portion at a lower part thereof as viewed from an extending direction of the toner releasing agent holding unit, and includes a first wall part opposing the at least one toner releasing agent applying member, and the toner releasing agent supply opening is formed on the first wall part in an extending direction of the toner releasing agent holding unit.

39. The image forming apparatus according to claim 38, wherein a toner releasing agent injecting member configured to inject toner releasing agent into the toner releasing agent holding unit is arranged at one side part of the toner releasing agent holding unit in the extending direction of the toner releasing agent holding unit.

40. The image forming apparatus according to claim 39, wherein the toner releasing agent holding unit is arranged such that the one side part of the toner releasing agent holding unit is higher than the other side part of the toner releasing agent holding unit in the extending direction of the toner releasing agent holding unit.

41. The image forming apparatus according to claim 38, wherein the toner releasing agent holding unit further includes a second wall part opposing the first wall part, and a toner releasing agent discharging outlet configured to discharge toner releasing agent from the toner releasing agent holding unit at a lower part of the second wall part than an uppermost end part of the first wall part.

42. The image forming apparatus according to claim 38, wherein the toner releasing agent holding unit is provided such that the first wall part inclines in an approaching direction toward the at least one toner releasing agent applying member.

43. A fixing apparatus for fixing a toner image on a recording material, comprising:

fixing means for fixing a toner image on a recording material, the fixing means being arranged on a recording material conveying path;

pressing means for press-contacting a surface of the fixing means; and a toner releasing agent applying device configured to convey and apply toner releasing agent onto the surface of the fixing means, the toner releasing agent applying device comprising, toner releasing agent holding means for holding toner releasing agent, the toner releasing agent holding means including a toner releasing agent supply opening;

permeable toner releasing agent delivering means for delivering toner releasing agent from the tone releasing agent holding means to the surface of the fixing means via a contact part on the toner releasing agent delivering means, the toner releasing agent delivering means being supplied with the toner releasing agent in the toner releasing agent holding means through the toner releasing agent supply opening, the contact part being arranged in an offset relationship from the toner releasing agent supply opening; and toner releasing agent conveying means for conveying toner releasing agent to the toner releasing agent holding means.

44. The fixing apparatus according to claim 43, wherein:

the toner releasing agent holding means is arranged in a vicinity of the fixing means and opposite to the fixing means at a distance apart, the toner releasing agent delivering means is arranged between the toner releasing agent holding means and the fixing means, and the toner releasing agent delivering means includes a first end surface which contacts the fixing means, and a second end surface opposing the first end surface and facing an inside of the toner releasing agent holding means through the toner releasing agent supply opening.

45. The fixing apparatus according to claim 43, wherein:

the toner releasing agent applying device further comprises at least one toner releasing agent applying means for applying toner releasing agent onto the surface of the fixing means, the toner releasing agent holding means is arranged in a vicinity of the at least one toner releasing agent applying means and opposite to the at least one toner releasing agent applying means at a distance apart, the toner releasing agent delivering means is arranged between the toner releasing agent holding means and the at least one toner releasing agent applying means, and the toner releasing agent delivering means includes a first end surface which contacts the at least one toner releasing agent applying means, and a second end surface opposing the first end surface and facing an inside of the toner releasing agent holding means through the toner releasing agent supply opening.

46. A fixing apparatus for fixing a toner image on a recording material, comprising:

fixing means for fixing a toner image on a recording material, the fixing means being arranged on a recording material conveying path;

pressing means for press-contacting a surface of the fixing means; and a toner releasing agent applying device configured to convey and apply toner releasing agent onto the surface of the fixing means, the toner releasing agent applying device comprising, toner releasing agent holding means for holding toner releasing agent, the toner releasing agent holding means including a toner releasing agent supply opening;

permeable toner releasing agent delivering means for delivering toner releasing agent from the toner releasing agent holding means to the surface of the fixing means, the toner releasing agent delivering means being supplied with the toner releasing agent in the toner releasing agent holding means through the toner releasing agent supply opening; and toner releasing agent conveying means for conveying toner releasing agent to the toner releasing agent holding means, wherein:

the toner releasing agent applying device further comprises at least one toner releasing agent applying means for applying toner releasing agent onto the surface of the fixing means, the toner releasing agent holding means is arranged in a vicinity of the at least one toner releasing agent applying means and opposite to the at least one toner releasing agent applying means at a distance part, the toner releasing agent delivering means is arranged between the toner releasing agent holding means and the at least one toner releasing agent applying means, the toner releasing agent delivering means includes a first end surface which contacts the at least one toner releasing agent applying means, and a second end surface opposing the first end surface and facing an inside of the toner releasing agent holding means through the toner releasing agent supply opening, the at least one toner releasing agent applying means includes a plurality of toner releasing agent applying means, and the at least one of the plurality of toner releasing agent applying means contacts the first end surface of the toner releasing agent delivering means, and the at least another one of the plurality of toner releasing agent applying means contacts the surface of the fixing means.

47. A method of applying toner releasing agent onto a surface of a fixing member in a fixing apparatus, comprising the steps of:

conveying toner releasing agent to a toner releasing agent holding unit;

holding the toner releasing agent in the toner releasing agent holding unit;

supplying the toner releasing agent to a permeable toner releasing agent delivering member through a toner releasing agent supply opening of the toner releasing agent holding unit; and delivering the toner releasing agent from the toner releasing agent delivering member to the surface of the fixing member via a contact part on the toner releasing agent delivering member, where the toner releasing agent delivering member is supplied with the toner releasing agent in the toner releasing agent holding unit through a toner releasing agent supply opening in the toner releasing agent holding unit, the contact part being arranged in an offset relationship from the toner releasing agent supply opening.

48. The method according to claim 47, wherein the step of delivering the toner releasing agent includes bringing the toner releasing agent delivering member into contact with the fixing member.

49. The method according to claim 47, wherein the step of delivering the toner releasing agent includes bringing the toner releasing agent delivering member into contact with at least one toner releasing agent applying member and delivering the toner releasing agent onto the surface of the fixing member via the at least one toner releasing agent applying member.

50. The method according to claim 47, wherein the step of conveying toner releasing agent includes injecting the toner releasing agent into the toner releasing agent holding unit with a toner releasing agent injecting member.

* * * * *